US010427275B2

(12) United States Patent
Gauthier et al.

(10) Patent No.: US 10,427,275 B2
(45) **Date of Patent: *Oct. 1, 2019**

(54) VARIABLE GEAR RATIO RATCHET

(71) Applicant: Gauthier Biomedical, Inc., Grafton, WI (US)

(72) Inventors: Michael T. Gauthier, Grafton, WI (US); Mara C. Schwartz, Glendale, WI (US); Robert F. Miller, Grafton, WI (US)

(73) Assignee: Gauthier Biomedical, Inc., Grafton, WI (US)

( * ) Notice: Subject to any disclaimer, the term of this patent is extended or adjusted under 35 U.S.C. 154(b) by 244 days.

This patent is subject to a terminal disclaimer.

(21) Appl. No.: 14/941,969

(22) Filed: Nov. 16, 2015

(65) Prior Publication Data

US 2016/0121465 A1 May 5, 2016

Related U.S. Application Data

(63) Continuation of application No. 13/891,555, filed on May 10, 2013, now Pat. No. 9,216,496, which is a continuation-in-part of application No. 12/849,867, filed on Aug. 4, 2010, now Pat. No. 8,468,914, which is a continuation-in-part of application No. 12/689,065, filed on Jan. 18, 2010, now Pat. No. 8,122,788, which is a continuation-in-part of application No. 12/354,939, filed on Jan. 16, 2009, now Pat. No. 7,987,745.

(60) Provisional application No. 61/645,897, filed on May 11, 2012.

(51) Int. Cl.

| | |
|---|---|
| ***B25B 17/02*** | (2006.01) |
| ***B25B 15/04*** | (2006.01) |
| ***B25B 23/142*** | (2006.01) |
| ***B25B 15/02*** | (2006.01) |
| ***B25B 17/00*** | (2006.01) |
| ***B25B 23/00*** | (2006.01) |

(52) U.S. Cl.

CPC ..... *B25B 17/02* (2013.01); *B25B 15/02* (2013.01); *B25B 15/04* (2013.01); *B25B 17/00* (2013.01); *B25B 23/0035* (2013.01); *B25B 23/142* (2013.01)

(58) Field of Classification Search

CPC ..... B25B 17/00; B25B 17/02
USPC ..... 81/57.31
See application file for complete search history.

(56) References Cited

U.S. PATENT DOCUMENTS

| | | | |
|---|---|---|---|
| 311,255 | A | 1/1885 | Pedersen |
| 919,156 | A | 4/1909 | Gilmore |
| 1,626,719 | A | 5/1927 | Callison |
| 1,762,515 | A | 6/1930 | Hiersch |

(Continued)

*Primary Examiner* — Hadi Shakeri
(74) *Attorney, Agent, or Firm* — Boyle Fredrickson, S.C.

(57) ABSTRACT

This invention relates to a fastener driving device including a variable ratio gear mechanism that enables the ratio of the rotation of the handle to the rotation of a driving bit extending from the handle to be varied to allow the bit to rotate at different speeds from the handle. The device includes a gear mechanism disposed within a housing for the device that includes a locking member. The locking member can be engaged with the gear mechanism to lock the gear mechanism in a configuration for a 1:1 gear ratio. The locking member can be moved with regard to the gear mechanism to provide an increased gear ratio for the gear mechanism when desired.

15 Claims, 34 Drawing Sheets

(56) References Cited

U.S. PATENT DOCUMENTS

| | | | | |
|---|---|---|---|---|
| 2,092,598 | A | 9/1937 | Blair | |
| 2,721,591 | A | 10/1955 | Criswell | |
| 3,315,545 | A * | 4/1967 | Schnoebelen | B25B 15/00 475/270 |
| 3,580,097 | A * | 5/1971 | Van Dalen | B25B 15/00 74/421 R |
| 4,341,292 | A | 7/1982 | Acevedo | |
| 4,341,293 | A | 7/1982 | Acevedo | |
| 4,846,027 | A | 7/1989 | Lu | |
| 5,289,743 | A | 3/1994 | Cirami | |
| 5,947,212 | A | 9/1999 | Huang | |
| 6,035,746 | A | 3/2000 | Lin | |
| 6,155,144 | A | 12/2000 | Lin | |
| 6,899,653 | B2 | 5/2005 | Murphy | |
| 7,650,821 | B2 | 1/2010 | Gauthier et al. | |
| 7,913,594 | B2 | 3/2011 | Gauthier et al. | |
| 7,987,745 | B2 | 8/2011 | Gauthier et al. | |
| 8,122,788 | B2 | 2/2012 | Gauthier et al. | |
| 8,468,914 | B2 | 6/2013 | Gauthier et al. | |
| 2007/0209486 | A1* | 9/2007 | Gauthier | B25B 13/463 81/467 |
| 2009/0025518 | A1* | 1/2009 | Gauthier | B25B 13/463 81/467 |
| 2010/0180732 | A1 | 7/2010 | Gauthier et al. | |
| 2010/0294084 | A1 | 11/2010 | Gauthier et al. | |

* cited by examiner 77
388
392
394
396
398
400
402
404
78

392
394
396
398
400
402
404
78
77
388

77
78
388
392
394
396
398
400
402
404

388
392
394
396
398
400
402
404
78
77

148'
149'
151'
152'
153'
154'
157'
162'
164'
168'
169'
194

950
952
958
960
962
964
954
956
914
918
928
930
932
934
936
938
940

VARIABLE GEAR RATIO RATCHET

CROSS-REFERENCE TO RELATED APPLICATIONS

This application claims priority as a continuation application from U.S. Non-Provisional application Ser. No. 13/891,555, filed May 10, 2013, which is a continuation-in-part application from U.S. Non-provisional application Ser. No. 12/849,867, filed Aug. 4, 2010, which is a continuation-in-part application of U.S. Non-Provisional patent application Ser. No. 12/689,065, filed Jan. 18, 2010, which is a continuation-in-part of U.S. Non-Provisional patent application Ser. No. 12/354,939, filed on Jan. 16, 2009, and from U.S. Provisional Application Ser. No. 61/645,897, filed May 11, 2012, the entirety of which are each hereby expressly incorporated by reference herein.

FIELD OF THE INVENTION

This invention relates to a device for driving or removing fasteners from a substrate, such as a screwdriver, that includes a ratcheting mechanism to assist in driving the fastener.

BACKGROUND OF THE INVENTION

In the past a variety of different types of devices have been developed to drive fasteners into a substrate for various purposes. The type of device most often utilized to drive the fastener is a screwdriver or similar device that translates the rotation of the screwdriver by the individual into rotation of the fastener to urge the fastener into the desired substrate.

On many occasions, the particular location where the fastener needs to be located, or the type of substrate into which the fastener is to be driven creates a certain amount of difficulty in driving the fastener into the substrate. To provide some assistance in driving the fasteners in these more difficult situations, many of these devices are constructed with a ratcheting mechanism. The ratcheting mechanism allows the individual to restrict the rotation of the driver to a single direction, which eases the difficulty of driving the fastener.

Nevertheless, the devices, whether including a ratcheting mechanism or not, produces only a one to one ratio between the rotation of the device by the individual and the corresponding rotation of the fastener. As a result, it normally takes a significant amount of time to completely drive the fastener into the substrate.

In an attempt to increase the speed of driving a fastener into a substrate, certain prior art devices have been developed that can alter the ratio of the rotation of the handle of the device with respect to the driving bit of the device, to thereby increase the speed of driving the fastener into the substrate. One device of this type is disclosed in Murphy U.S. Pat. No. 6,899,653, which discloses a fastener with a gear assembly. In this device, the fastener includes a plate having a number of openings formed therein. The plate is connected to a sun gear which engages a number of planetary gears positioned between the sun gear and a ring gear disposed on the exterior of the device. When engaged with and allowed to rotate freely with the planetary gears and the ring gear, the sun gear rotates at a speed faster than the rotation of the handle, at a ratio of approximately four rotations of the sun gear for each revolution of the handle. Further because the driving bit for the device is fixed to the sun gear, the bit also rotates at the 4:1 ratio to drive the fastener engaged with the bit into the substrate at a speed greater than the rotation of the device handle by the individual.

The device also includes a switch located on the exterior of the device, and that is slidably movable with respect to the device. The switch includes a pin that can be selectively engaged and disengaged with one of the openings in the plate to which the sun gear is attached. Thus, when the pin is engaged with the plate, the pin prevents the plate and the sun gear from rotating separately from one another, so that the sun gear, as well as the bit connected thereto, and the handle rotate in a 1:1 ratio.

However, while providing a design that enables the device to be operated at different gear ratios to increase the speed of the driving bit as desired, the device requires a separate switching mechanism to transition the device between the different gear ratios. This requires an additional and separate mechanism to be formed on the device, which significantly complicates the construction and operation of the device. In addition, the switching mechanism relies solely on the frictional engagement of the pin with the plate to maintain the lock between the plate and the pin, such that the switching mechanism can be inadvertently disengaged in a relatively easy manner. Also, the switching mechanism requires the alignment of the pin with an associated opening in the plate in order to engage the switching mechanism, which often requires that the device to be moved from a desired position in order to align the pieces of the switching mechanism.

Accordingly, the prior art does not satisfy the needs and solutions required for devices of this type, such that it is desirable to develop a fastener-driving device that provides a simple construction and mechanism for altering the speed of rotation of the driving shaft relative to the handle.

SUMMARY OF THE INVENTION

It is one object of the present invention to provide a fastener driving device including a variable ratio gear mechanism that enables the ratio of the rotation of the handle to the rotation of a driving bit extending from the handle to be varied to allow the bit to rotate at different speeds from the handle. The device includes a gear mechanism disposed within a housing for the device that includes a sun gear attached to a shaft extending through the housing and to which a driving bit can be connected. A number of planetary gears are disposed around the sun gear and operably engage the sun gear and the shaft with a ring gear secured to the housing. The planetary gears are disposed on a cover that is connected to a handle for the device, such that the rotation of the handle causes the planetary gears to rotate relative to the sun gear.

The cover also encloses a locking member and a biasing member between the cover and the handle. The biasing member urges the locking member into engagement with the sun gear to lock the sun gear and the planetary gears to one another. A selector switch is secured to the device over the gear mechanism and is operable to move the locking member into and out of engagement with the planetary gears against the hiss of the biasing member.

According to another object of the present invention, the selector switch is continually biased into engagement with the planetary gears by the biasing member to avoid any inadvertent disengagement of the switch and consequent alteration of the gear ratio at which the device is operating.

According to still another object of the present invention, the locking member and the switch can be combined to further simplify the construction the construction for the device.

According to still another aspect of the present invention, instead of the biasing members, the locking member/switch can be held in the engaged and disengaged positions by mechanical engagement means.

Numerous additional objects, aspects and advantages of the present invention will be made apparent from the following detailed description taken together with the drawing figures.

BRIEF DESCRIPTION OF THE DRAWINGS

The drawings illustrate the best mode of practicing the present invention.

In the drawings:

FIG. 18 is a rear isometric view of the locking member of FIG. 17;

FIG. 38 is an isometric view of a planetary gear body of the device of FIG. 27;

FIG. 48 is an isometric, exploded view of the locking collar and ring gear;

FIG. 49 is a front plan view of the locking collar and ring gear of FIG. 48;

FIGS. 62A-B are partially broken away views of the locking collar of the device of FIG. 60 in an engaged position;

DETAILED DESCRIPTION OF THE INVENTION

Figure 1:
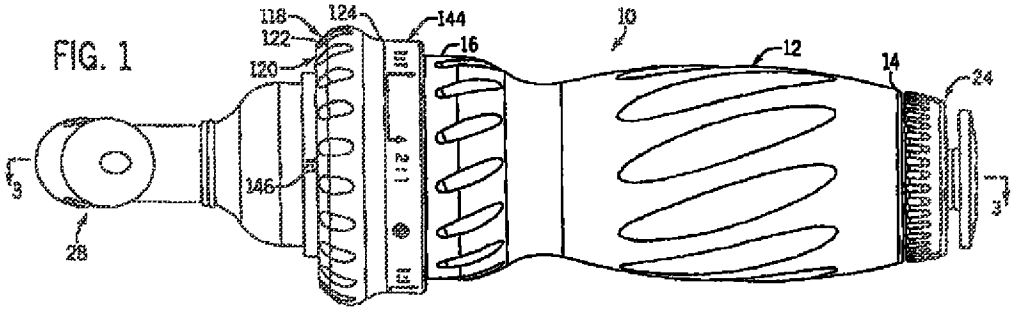
FIG. 1 is a side pan view of a first embodiment of the driving device constructed according to the present invention in a locked position.
Figure 2:
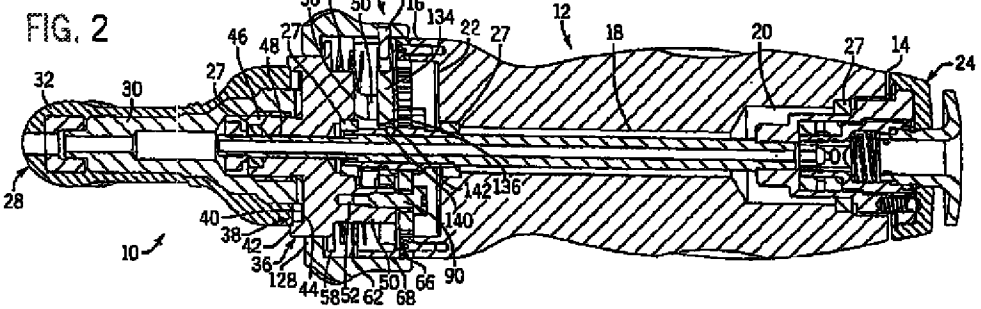
FIG. 2 is a cross-sectional view of the driving device of FIG. 1.
Figure 3:
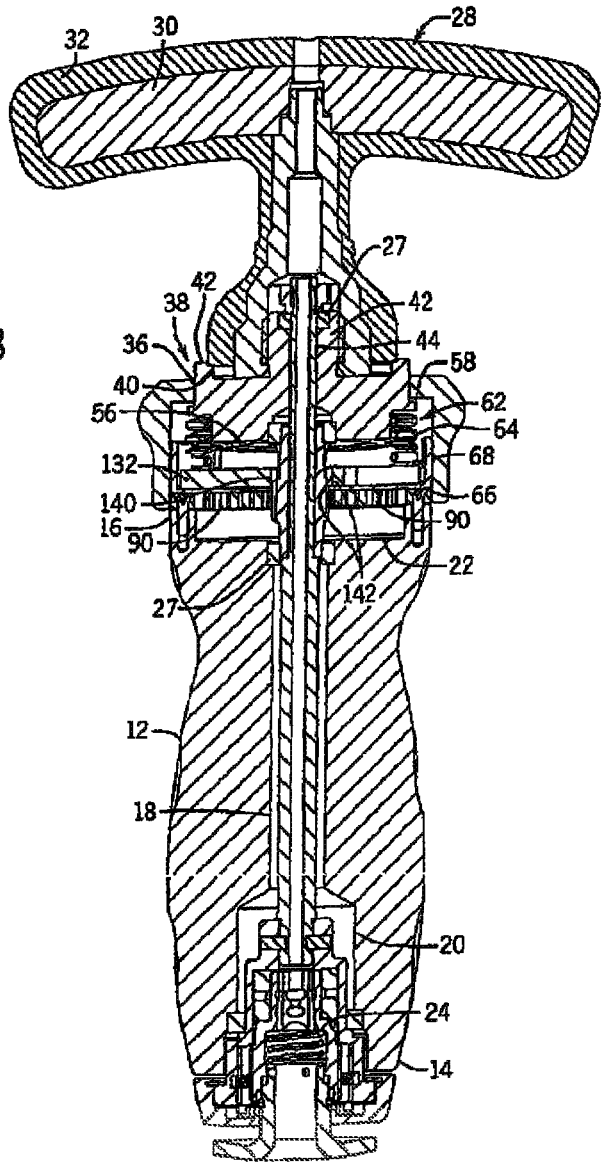
FIG. 3 is a cross-sectional view along line 3-3 of FIG. 1.
Figures 4A, 4B:
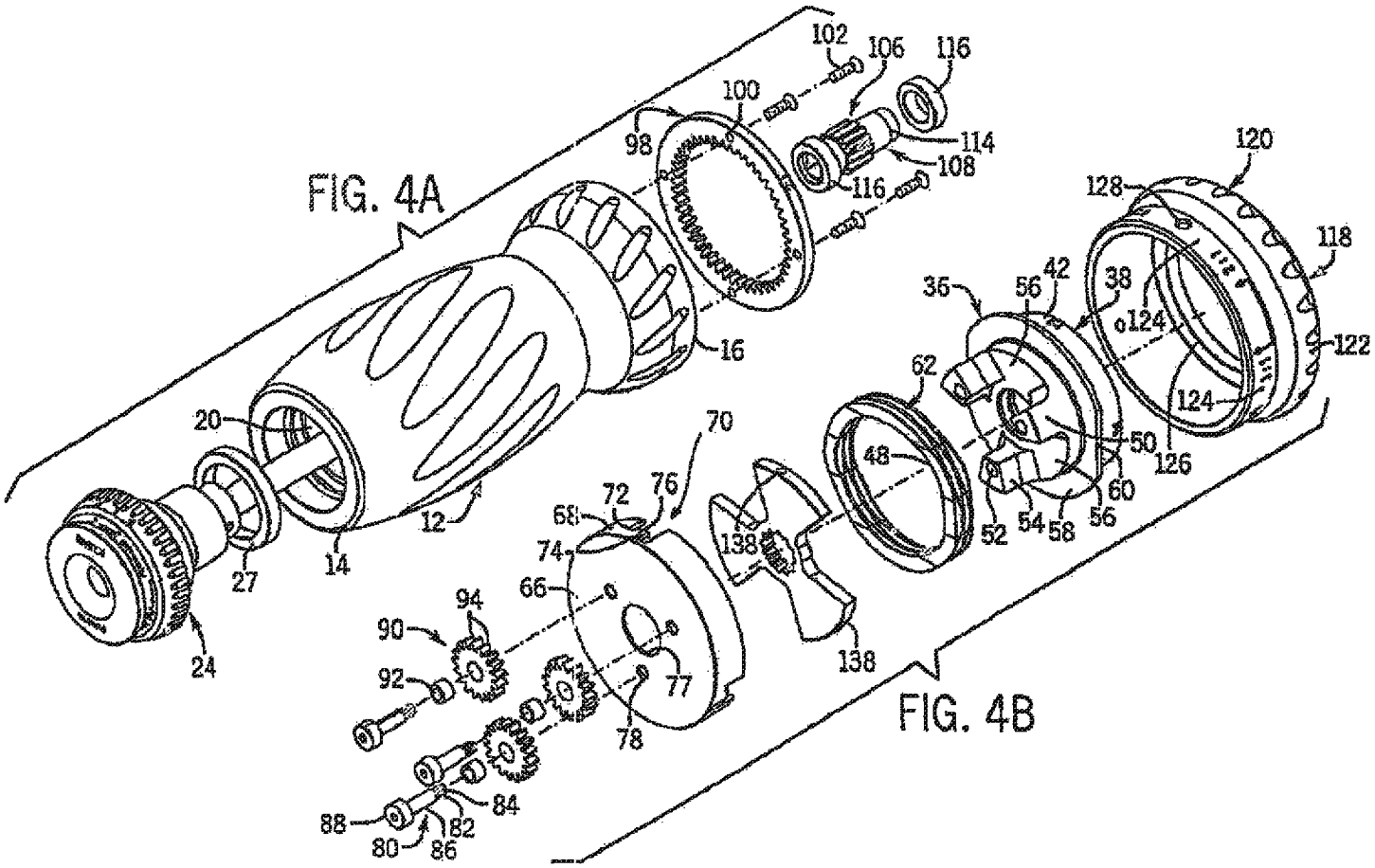
FIGS. 4A-4C are isometric exploded views of the device of FIG. 1.
Figure 4C:
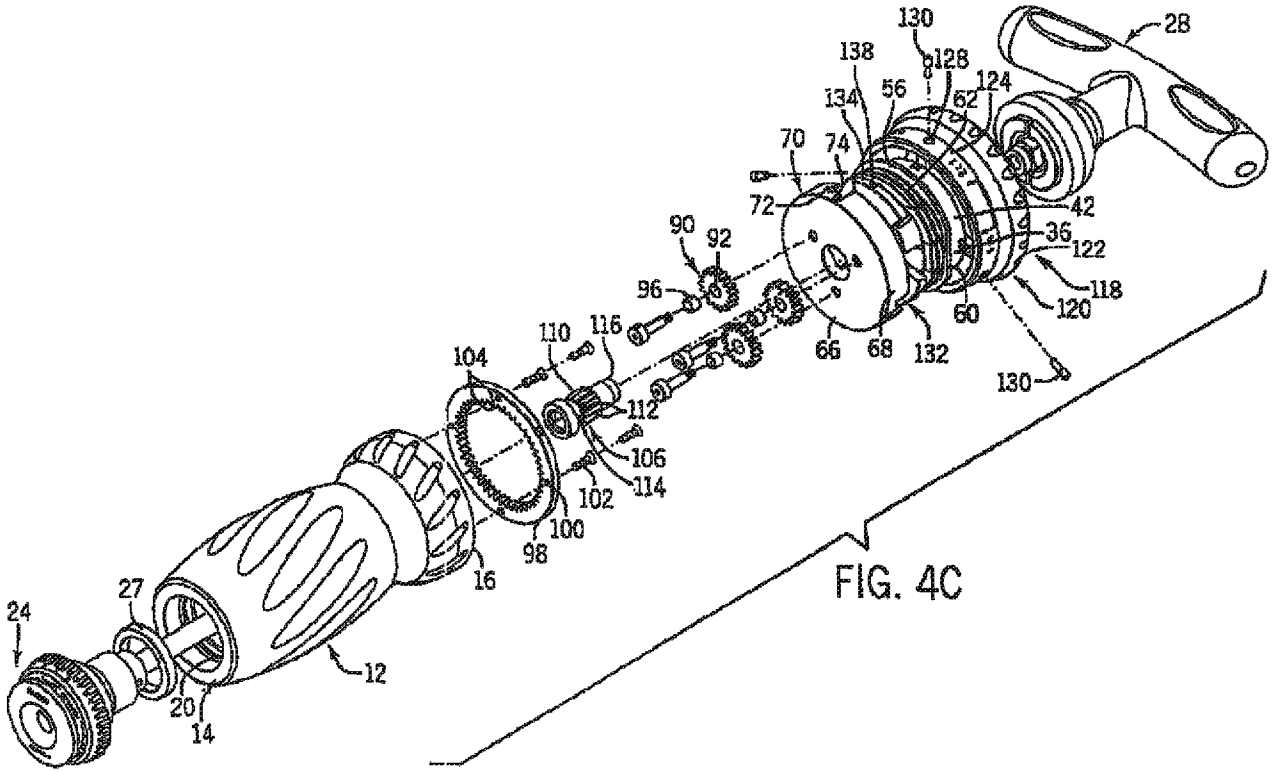
Figure 5:
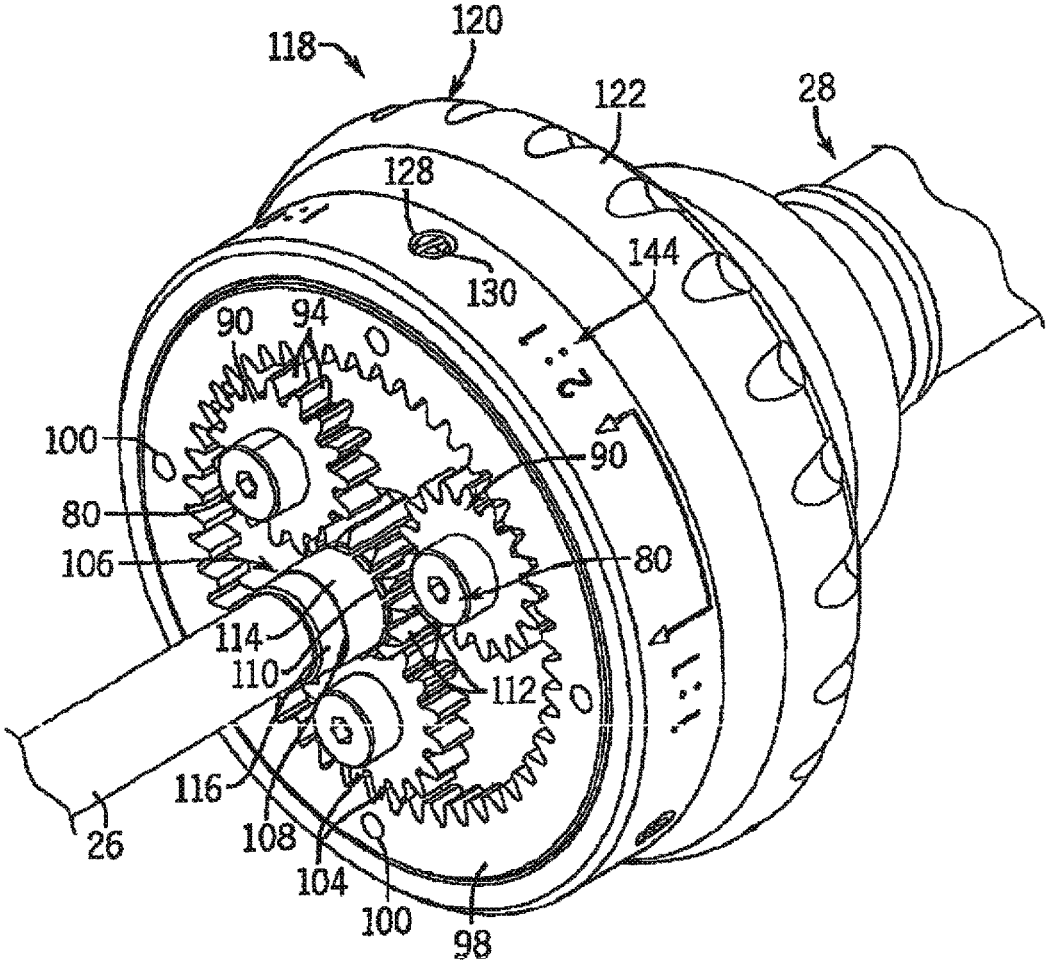
FIG. 5 is a partially broken away isometric view of the gear mechanism of the device of FIG. 1.
Figure 6:
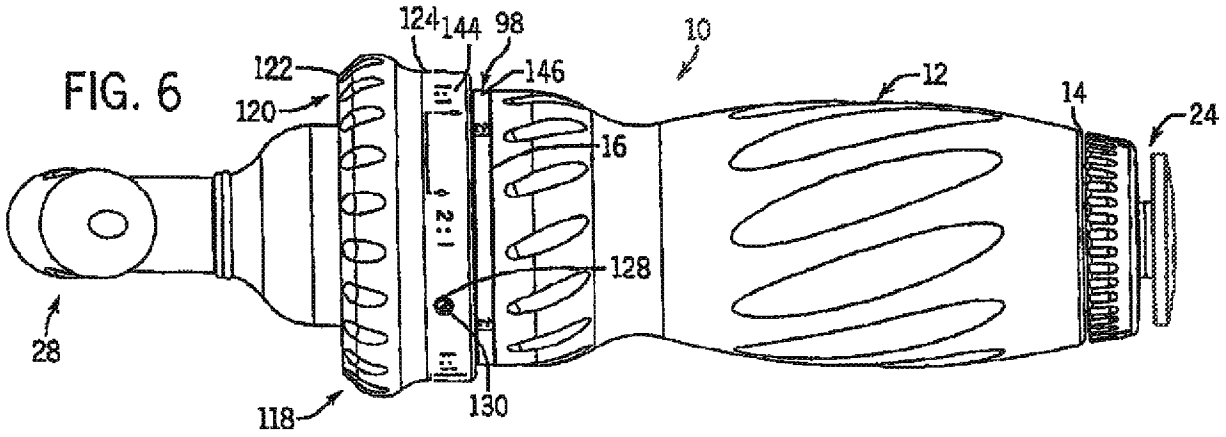
FIG. 6 is a side pan view of the driving device of FIG. 1 in an unlocked position.
Figure 7:
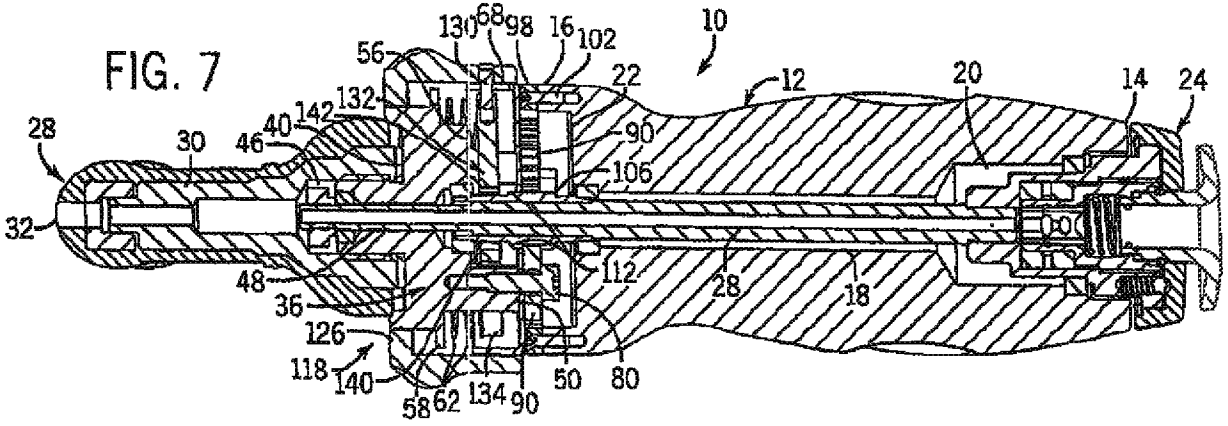
FIG. 7 is a cross-sectional view of the driving device of FIG. 6.

With reference now to the drawing figures in which like reference numbers represent like features throughout the application, a tool or device constructed according to the present invention is indicated at 10 in FIG. 1. The device 10 includes a housing 12 having a first end 14 and a second end 16. The shape of the housing 12 can be made to have any desired and ergonomic configuration, and can be made of any suitable material, with a material that is both impervious to fluids and able to be sterilized in any conventional manner being especially preferred. Additionally, the material forming the housing 12 can be selected from a material having the desired properties that can be molded around the other components used in the formation of the device 10.

Referring now to FIGS. 1-4C, the housing 12 includes a central passage 18 extending therethrough that includes a first expanded section 20 at the first end 14 and a second expanded section 22 at the second end 16. Within the first expanded section 20 is disposed a suitable ratcheting mechanism 24, such as that disclosed in co-pending and co-owned U.S. patent application Ser. No. 12/241,696, the entirety of which is expressly incorporated by reference herein in its entirety. The ratcheting mechanism 24 is held in the first expanded section 20 in any suitable manner to maintain fluid-impervious and sterilizable construction of the device 10. The mechanism 24 is also capable of releasably receiving and engaging a driving member (not shown) therein that is used to directly engage a fastener (not shown) to enable the device 10 to drive the fastener into the desired substrate (not shown). The ratcheting mechanism 24 is preferably operable to restrict the rotation of the driving member to one direction, or to hold the driving member stationary when the device 10 is in use.

A shaft 26 is disposed within and extends through the central passage 18 between the expanded sections 20 and 22. The shaft 26 is held within the passage 18 by a number of bearings 27 that allow the shaft 26 to rotate freely in the passage 18. The shaft 26 is also operably connected at one end to the ratcheting mechanism 24, such that the rotation of the shaft 26 is controlled by the operation of the ratcheting mechanism 24. Opposite the ratcheting mechanism 24, the shaft 26 is affixed to a handle 28 that can be grasped and turned by an individual in order to operate the device 10. The handle 28 can have any desired shape and configuration to maintain the fluid-proof and sterilizable structure, but in a preferred embodiment is formed of an interior component 30 formed of a rigid material and an outer resilient cover 32. The interior component 30 enables the handle 28 to accommodate the stresses utilized in the operation of the device 10, while the cover 32 provides a softer feel to the handle 28 when in use. The interior component 30 is not affixed to the shaft 26 opposite the ratcheting mechanism 24, such that the turning motion applied to the handle 28 is not directly transmitted to the shaft 26 to turn the shaft 26 along with the handle 28, but is directed to a gear mechanism 34 operably connecting the handle 28 and the shaft 26.

Between the handle 28 and the housing 12 is disposed a gear mechanism 34 that is disposed within the second expanded section 22 of the passage 18. The mechanism 34 includes a support member 36 that is engaged with the handle 28. The support member 36 includes an outer end 38 including an inwardly extending recess 40. The recess 40 has a rim 42 that has a diameter greater than the outer diameter of the handle 28, such that the handle 28 can be engaged with the support member 36 within the recess 40. Preferably there is a sealing member 44 disposed in the recess 40 to be engaged with the handle 28 to provide a fluid-tight engagement of the handle 28 with the support member 36, however, the member 44 can be omitted with its function provided by the cover 32.

The support member 36 also includes a projection 46 extending outwardly from the recess 38. The projection 46 is inserted into the handle 28 to further affix the handle 28 the housing 12. The projection 46 also includes a central opening 48 located concentrically within the projection 46 that extends completely through the projection 46 and the support member 36. The opening 48 is additionally disposed in concentric alignment with the passage 18 in the housing 12, and has a sufficient diameter to enable the shaft 26 to extend through the opening 48 in order to be engaged within the handle 28.

Opposite the projection 46, the support member 36 includes a number of attachment members 50. The attachment members 50 extend outwardly from the support member 36 and each include a blind bore 52 therein. The attachment members 50 are disposed around the opening 48, and taper inwardly towards the opening 48. Each attachment member 50 includes a pair of flat side walls 54, and are separated from one another by a flat section 56 of the support member 38, for a purpose to be described.

Between the projection 46 and the attachment members 50, the support member 36 includes a radially outwardly extending flange 58. The flange 58 includes a pair of flat sides 60 disposed opposite one another. The flange 58 serves as an engagement point for a number of biasing members 62 that are positioned on the flange 58 around the attachment members 50. The biasing members 62 can have any desired form, but are preferably springs 64, such as wave washers or compression springs. The biasing members 64 are retained against the flange 58 by a cover 66 secured to the support member 36. Preferably, the cover 66 is circular in shape and includes an axially extending wall 68 extending outwardly therefrom. Within the wall 68 are located a number of slots 70. Each slot 70 is preferably spaced equidistant from the remaining slots 70 around the perimeter of the wall 68, and includes a pair of notches 72 and 74 spaced from one another by a spacing section 76. The notch 74 is formed with a depth greater than the depth of the notch 72, for a purpose to be described.

The cover 66 also includes a central aperture 77 and a number of apertures 78 therein that are aligned with the bores 52 in the respective attachment members 50. The cover 66 is affixed to the attachment members 50 over the biasing members 64 by screws 80 inserted through the apertures 78 and into engagement within the bores 52 in the attachment members 50. The screws 80 are preferably formed with an end portion 82 on which threads 84 are located for engagement within the bore 52, a smooth shaft 86 extending away from the end portion 82, and a head 88 used to engage the end portion 82 within the bore 52. The smooth shaft 86 is present to enable a planetary gear 90 to be mounted to each screw 80. The planetary gear 90 is formed of any suitable material with a first width $W_1$, and includes a central opening 92 and a number of teeth 94 disposed around the periphery of the gear 90. The central opening 92 is dimensioned to have a diameter larger than that of the shaft 86 for the screw 80, such that the shaft 86 can be inserted through the opening 92, preferably with sufficient space for a bearing 96 to be positioned between the shaft 86 and the gear 90 within the opening 92.

Around the planetary gears 90 is located an annulus or ring gear 98. The ring gear 98 is affixed to the housing 12 around the second expanded section 22 at the second end 16 of the housing 12. The ring gear 98 includes a number of bores 100 through which suitable fasteners 102 are inserted to engage the ring gear 98 around the periphery of the second expanded section 22. Additionally, the ring gear 98 is formed to have a width $W_1$ corresponding to the width of the planetary gears 90, such that the ring gear 98 and planetary gears 90 are essentially coplanar with one another. The ring gear 98 further includes a number of teeth 104 disposed along the inner periphery of the ring gear 98 that are engaged by the aligned teeth 94 disposed on each of the planetary gears 90, such that rotation of the planetary gears 90 causes the rotation of the ring gear 98, and vice versa.

The planetary gears 90 are secured to the cover 66 opposite the support member 36, such that the gears 90 do not interfere with the operation of the biasing members 64, and around the aperture 77 formed in the center of the cover 66. The aperture 77 allows for the shaft 26 to extend therethrough, and has a diameter large enough to accommodate a sun gear 106 therein. The sun gear 106 is formed as a hollow sheath 108 disposed around the shaft 26 that includes a central part 110, from which extend a number of teeth 112, and a pair of end parts 114 that extend axially from each end of the central part 110. The sheath 108 is affixed to the shaft 26, such that the sheath 108 rotates in conjunction with the shaft 26. Further, the end parts 114 each support a bearing 116 thereon that engages the interior of the passage 18 to hold the sun gear 106 securely within the device 10, while also allowing the gear 106 and shaft 26 to rotate freely therein. Also, the teeth 112 on the central part 110 contact and engage the teeth 94 on the planetary gears 90, such that rotation of the sun gear 106 will cause consequent rotation of the planetary gears 90, or vice versa.

Additionally, the central part 102 has a second width $W_2$, which is greater than the width $W_1$ of the planetary gears 90 and the ring gear 98, such that the teeth 112 on the central part 110 axially extend beyond the teeth 94 on the planetary gears 90 in both axial directions. The portion of the teeth 112 that extend through the aperture 77 in the center of the cover 66 can be selectively contacted by a switch 118 to control the gear ratio achieved by the sun gear 106, planetary gears 90 and ring gear 98.

The switch 118 includes a ring 120 slidably mounted to the exterior of the support member 36. The ring 120 includes an enlarged section 122, positioned adjacent the handle 28, and a reduced section 124, disposed around the wall 68 of the cover 66 and the ring gear 98, that are joined to or integrally formed with one another to form the ring 120. The enlarged section 122 includes a radially inwardly extending rim 126 that is slidably positioned around the support member 36 between the rim 42 and the flange 58 to operably connect the ring 122 to the support member 36.

Looking now at FIGS. 2, 4B, 4C, and 5-7, opposite the rim 126, the reduced section 124 of the ring 120 includes a number of openings 128 extending radially therethrough. The openings 128 receive suitable fasteners 130 therein which operate to connect the reduced section 124 of the ring 120 to a locking member 132. The locking member 132 is formed of any suitable, and preferably rigid material, and is shaped to have a fan blade-like shape, with a number of, e.g., preferably three, sections 134 extending radially outwardly from a central hub 136. Each of the sections 134 is dimensioned to be positionable within the flat sections 56 of the support member 36 formed between the attachment members 50, and preferably have an area less than the area of the flat sections 56 to allow some movement of the sections 134 with respect to the flat sections 56. The sections 134 also each include a bore 138 at their outer ends within which the fastener 130 is inserted to engage the ring 120 with the locking member 132. In one embodiment the bore 138 is disposed in an off-center position within the section 134. Each of the fasteners 130 is inserted through a slot 70 in the wall 68, which enables the fastener 130 to function as a stop for the movement of the locking member 132 with respect to the wall 68 and the cover 66.

The locking member 132 is also continuously engaged by the biasing members 64, such that the biasing members 64 urge the locking member 132 away from the support member 36 and towards the cover 66. Also, due to the positioning of the fasteners 130 within the slots 70, the biasing members 64 press the fasteners 130 against the inner end of one or the notches 72 or 74 formed in the slot 70, to maintain the fasteners 130, and consequently the locking member 132, at the particular location within the slot 70.

Looking now at FIGS. 2, 3, 4B and 7, the hub 136 of the locking member 132 also defines an opening 140 therein through which the shaft 26 can extend. The opening 140 also includes a number of teeth 142 disposed along the periphery of the opening 140 that are selectively engageable with the teeth 112 on the sun gear 106. When the fasteners 130 are disposed in the deeper notch 74 (FIG. 4B), the teeth 142 in the opening 140 are positioned in engagement with the teeth 122 on the sun gear 106. In this position, due to the engagement of handle 28 with the shaft 26 via the support member 36, cover 66 and the locking member 132, when rotating the handle 28 while grasping the housing 12, the rotation of the shaft 26 is in a 1:1 ratio with the rotation of the handle 28. Conversely, when the fasteners 130 are disposed within the notch 72 in each slot 70 (FIG. 4B), the opening 140 and teeth 142 are spaced from the teeth 112 on the sun gear 106. Therefore, when the handle 28 is rotated to turn the shaft 26 while holding the housing 12 stationary, the rotation of the handle 28 is transmitted through the support member 36 to the cover 66, which in turn rotates the planetary gears 90 due to their movement along the ring gear 98. The rotation of the planetary gears 90 it directly transmitted to the sun gear 106, which provides a ratio in excess of a 2:1 gear ratio to rotate the shaft a minimum of two revolutions for every single revolution of the handle 28.

In either position, the switch 118 maintained in the selected position during operation of the device 10 due to the force exerted by the biasing members 64 on the locking member 132 and the depth of the notches 72 and 74, which keeps the fasteners 130 disposed within the selected notch 72 or 74. When it is desired to change the gear ratio for the device 10, the switch 118 is grasped and urged towards the handle 28 against the bias of the biasing members 64. Once the fasteners 130 have been moved out of the notch 72 or 74 in which they were located, the switch 118 can be rotated with respect to the cover 66 and support member 36 to position the fasteners 130 in alignment with the other notch 72 or 74 corresponding to the desired gear ratio. At that point, the switch 118 can be released and the biasing members 64 will urge the fasteners 130 into the desired notch 72 or 74 to reengage the switch 118 with the cover 66. Further, the depth of the notches 72 and 74 are formed to enable the locking member 132 to be positioned out of engagement with the sun gear in notch 72, and in engagement in notch 74.

Preferably, the reduced section 124 of the ring 120 also includes indicia 144 thereon to assist in properly positioning the switch 118 in the location for the desired gear ratio. Further, both the support member 36 and the ring gear 98 can have printed indicia 146 on the exterior thereof indicating the gear ratio at which the device 10 is currently operating. This indicia 146 becomes exposed on the particular part of the device 10 when the switch 118 is moved into engagement with the notch 72 or 74 on the cover 66 corresponding to that gear ratio.

Figure 8:
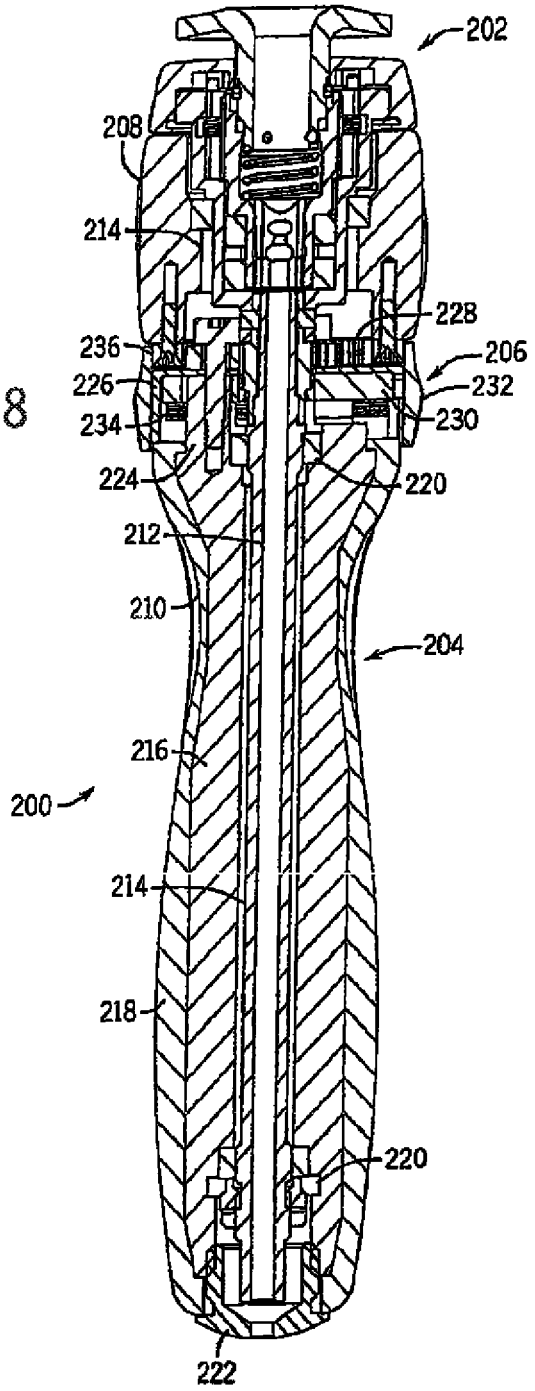
FIG. 8 is a cross-sectional view of a second embodiment of the driving device constructed according to the present invention.
Figure 9:
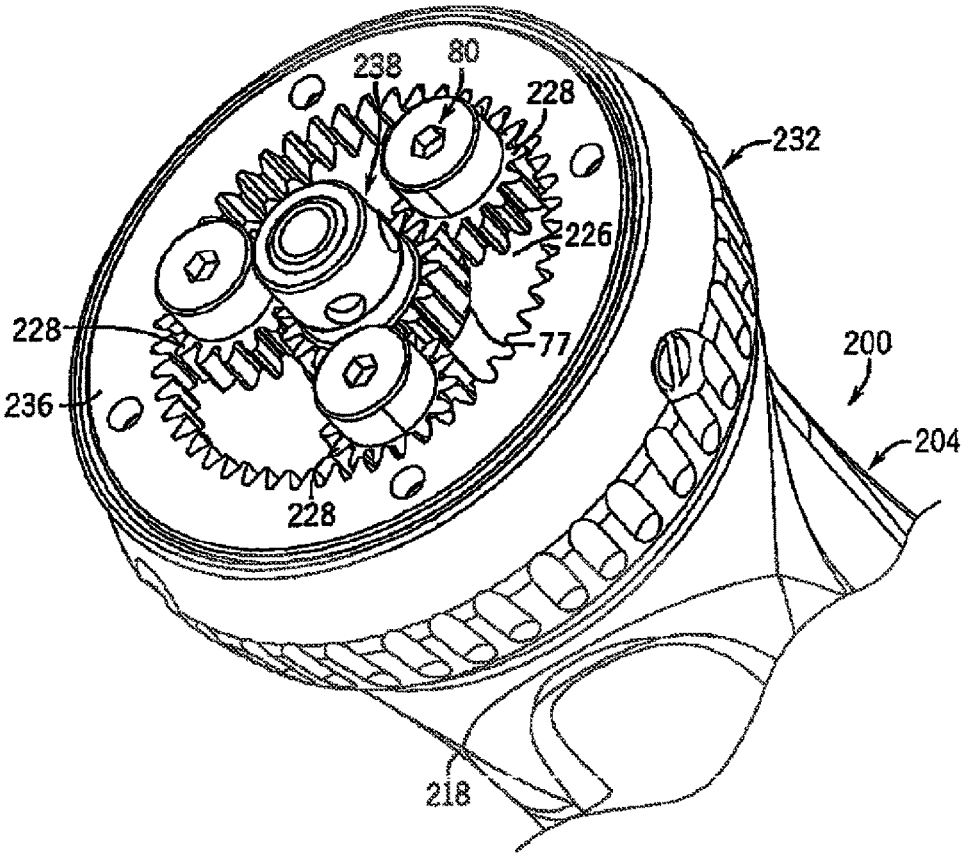
FIG. 9 is a partially broken away isometric view of the gear mechanism of the device of FIG. 8.
Figure 10:
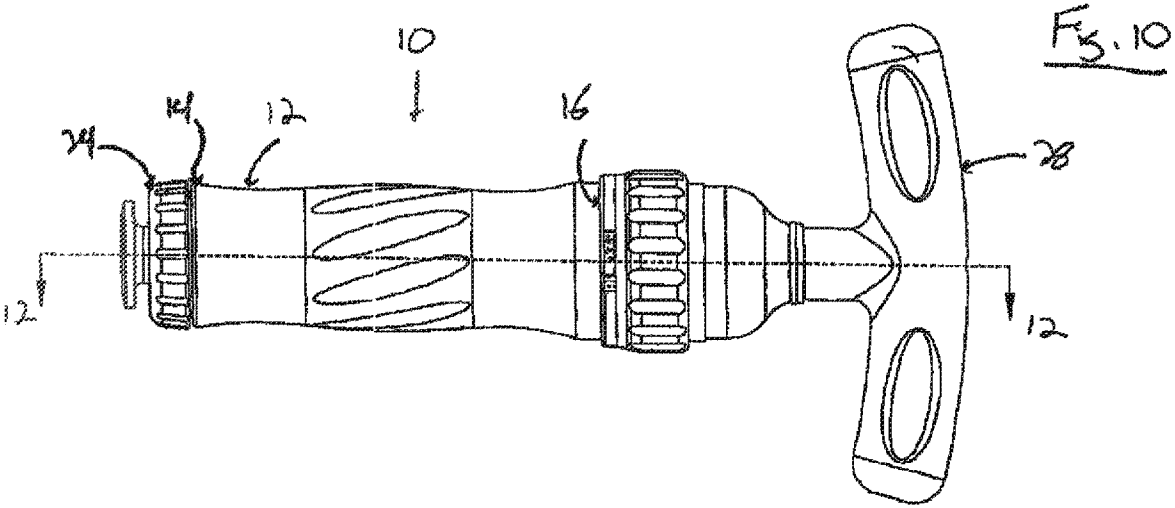
FIG. 10 is a side plan view of a third embodiment of the driving device constructed according to the present invention.

In a second embodiment of the device 200 shown in FIGS. 8 and 9, the device 200 includes the ratcheting mechanism 202 positioned on the same end of the housing 204 as the gear mechanism 206. In this embodiment, the housing 204 is formed of a front portion 208 and a rear portion 210 connected to one another via the shaft 212. The shaft 212 is connected to the ratcheting mechanism 202 that is disposed a part of the passage 214 formed in the front portion 208, and extends rearwardly from the mechanism 202 into the rear portion 210. The passage 214 in the rear portion 210 is formed within a generally rigid inner member 216, around which is formed a softer material member 218. The shaft 212 is engaged within the passage 214 by a number of bearings 220 to allow the shaft 212 to rotate without interference from the housing 204, and is covered opposite the ratcheting mechanism 202 by and end cap 222.

In this construction for the device 200, the support member 36 of the first embodiment is replaced by the inner member 216 of the housing 204, from which the various attachment members 224 extend. Thus, the cover 226, and planetary gears 228 are connected directly to the inner member 216, with the locking member 230 and switch 232 being connected to the cover 226 using the slots (not shown) and the notches (not shown) in the same manner as described above. Additionally, the biasing members 234 are also disposed between the inner member 16 and the locking member 230 to bias the locking member 230 into engagement with the slots in the cover 226, regardless of the selected gear ratio, in the same manner as described previously. The ring gear 236 is affixed to the front portion 208 and is positioned around and in engagement with the planetary gears 228 in the assembled device 200.

In the device 200, the switch 232 can be moved with regard to the cover 226 as described previously to shift the position of the locking member 230 and cause the rotation of the sun gear 238 on the shaft 212 at the desired ratio.

Figure 12:
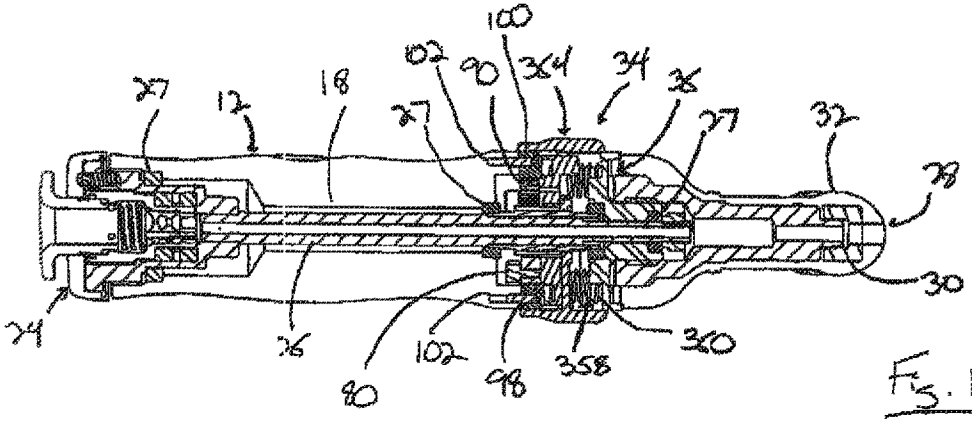
FIG. 12 is a cross-sectional view taken along line 12-12 of FIG. 10.
Figures 11A, 11B, 11C:
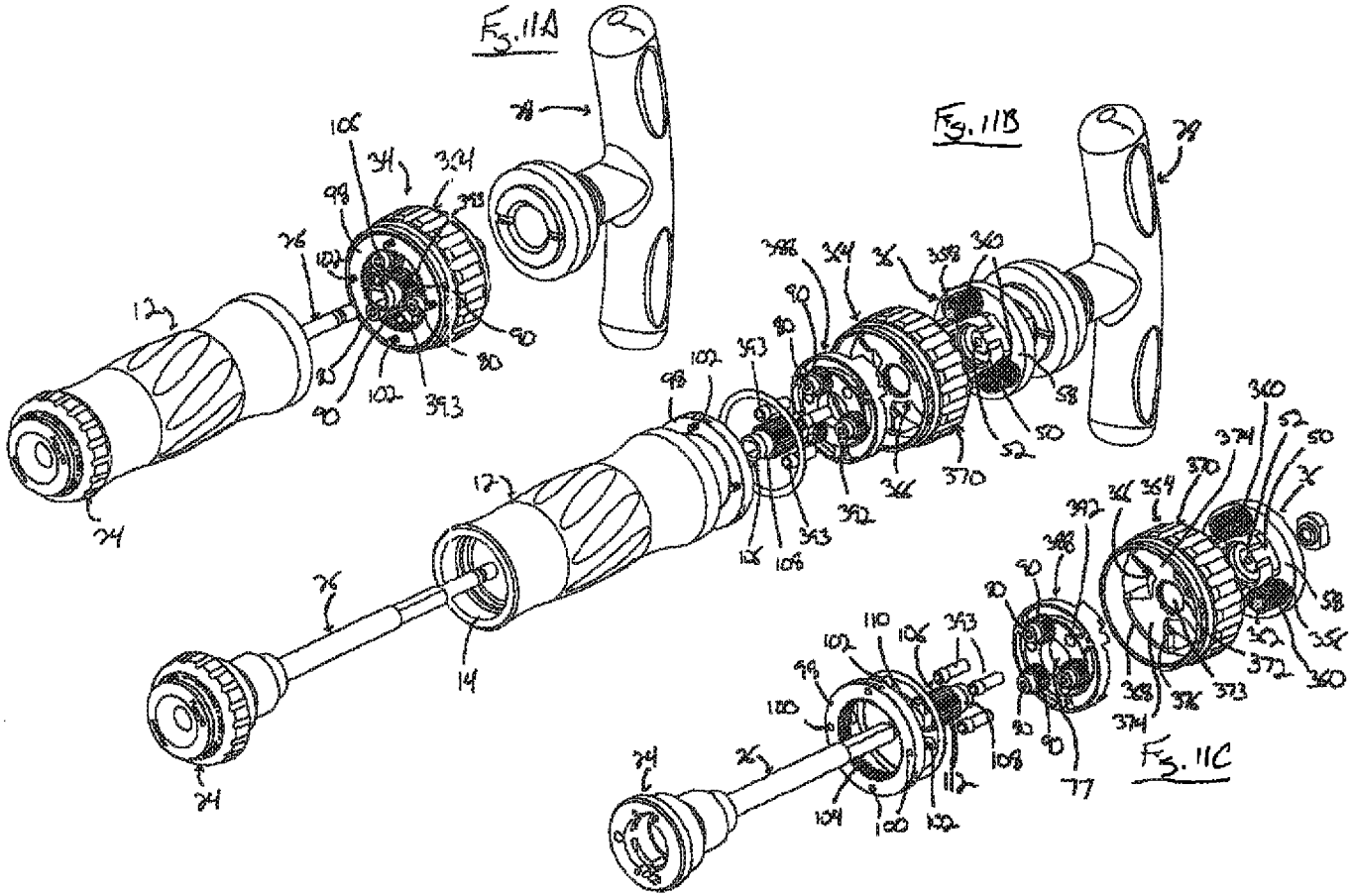
FIGS. 11A-11C are isometric exploded views of the device of FIG. 10.
Figure 14:
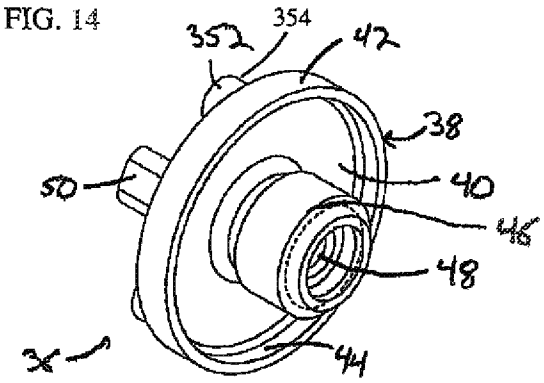
FIG. 14 is a rear isometric view of the support member of FIG. 13.
Figure 13:
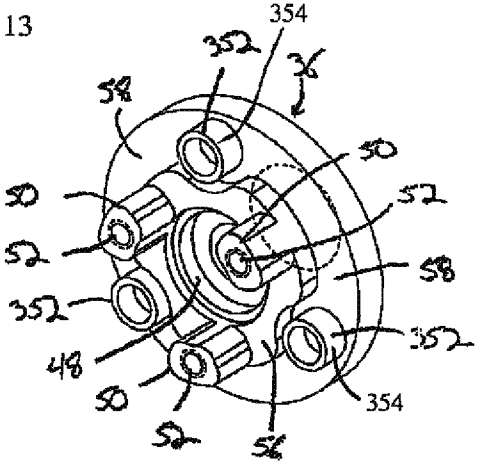
FIG. 13 is a front isometric view of a support member of the device of FIG. 12.
Figure 15:
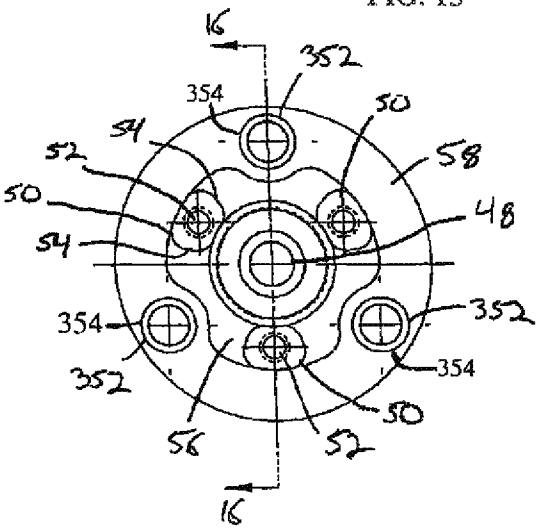
FIG. 15 is a front plan view of the support member of FIG. 13.
Figure 16:
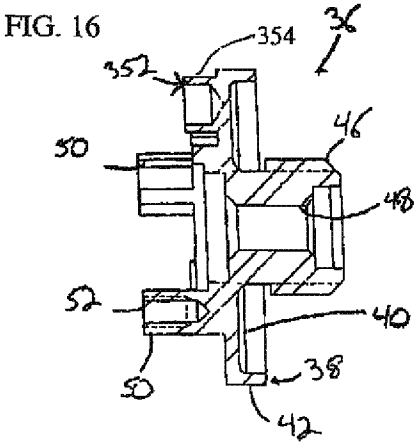
FIG. 16 is a cross-sectional view along line 16-16 of FIG. 15.
Figure 16:
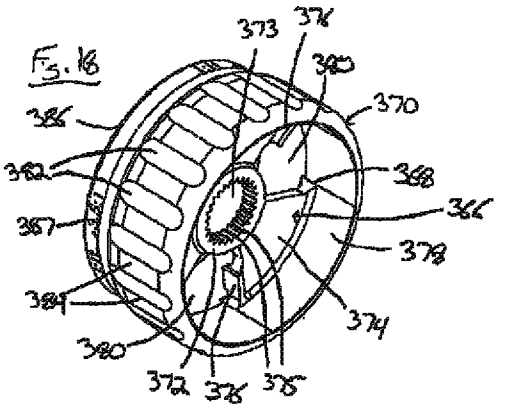
Figure 20:
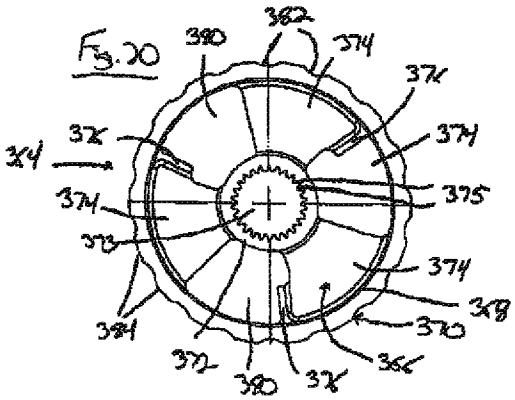
FIG. 20 is a rear plan view of the locking member of FIG. 17.
Figure 17:
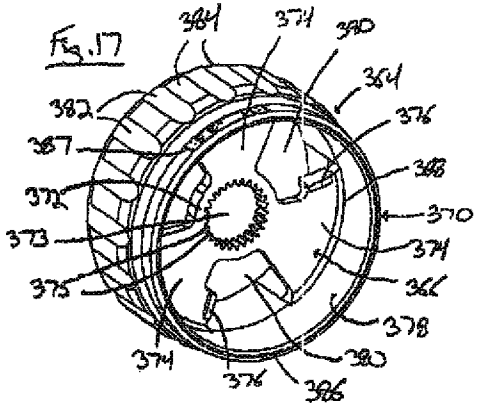
FIG. 17 is a front isometric view of a locking member of the device of FIG. 12.
Figure 19:
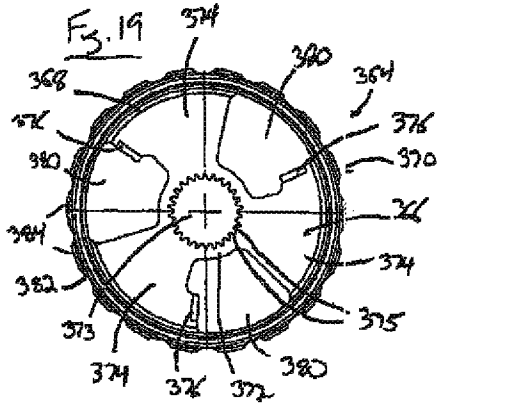
FIG. 19 is a front plan view of the locking member of FIG. 17.
Figure 21:
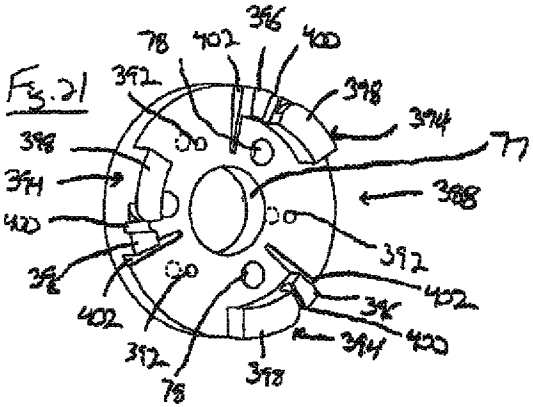
FIG. 21 is a front isometric view of a plate member of the device of FIG. 12.
Figure 22:
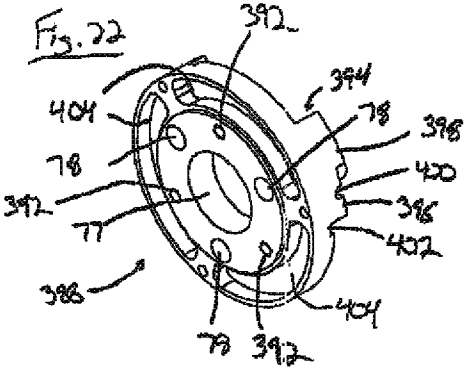
FIG. 22 is a rear isometric view of the plate member of FIG. 21.
Figure 23:
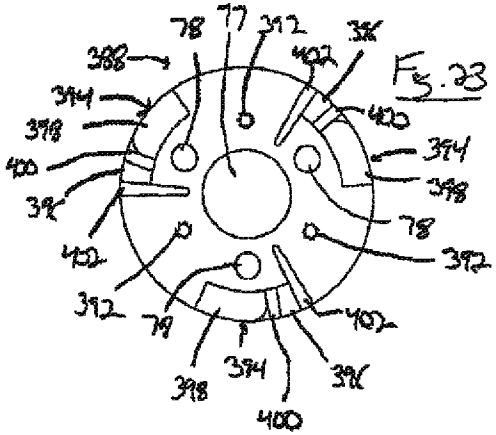
FIG. 23 is a front plan view of the plate member of FIG. 21.
Figure 24:
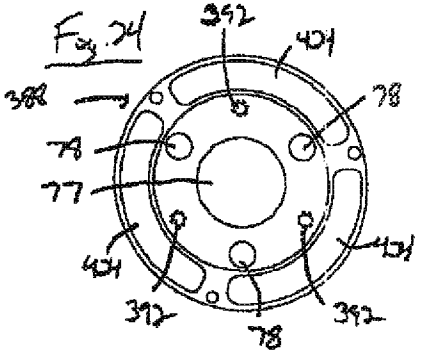
FIG. 24 is a rear plan view of the plate member of FIG. 21.

A third embodiment of the gear mechanism. 34 for the tool 10 is shown in FIGS. 10-26, where, as in the previous embodiments, opposite the projection 46, the support member 36 includes a number of attachment members 50, as best shown in FIGS. 13-16. The attachment members 50 extend outwardly from the support member 36 and each includes a blind bore 52 therein. The attachment members 50 are disposed around the opening 48, and taper inwardly towards the opening 48 and are separated from one another by the flat sections 56. Around the attachment members 50 and flat sections 56 are located a number of projections 352 extending outwardly away from the flange 58. The projections 352 have an exterior surface 354 (FIGS. 13-16 that is configured to engage one end 356 of the biasing members 358, (FIGS. 11A-12) and which can have any desired form, but in the current embodiment are formed as compression springs 360 with the first end 356 and a second end 362 disposed opposite the first end 356. The springs 360 preferably have a generally cylindrical shape in order to be more readily engaged with the projections 352, but can be formed to have any suitable shape complementary to and easily engageable with the projections 352. In addition, the springs 360 are engaged axially around the exterior surfaces 354 of the projections 352 in any suitable manner, such as by mechanically, adhesively, etc., engaging the end 356 with the surface 354 of the projection 352, to retain the end 356 of the spring 360 in engagement with the support member 36.

The opposed end 362 of each of the springs 360 extends outwardly beyond the projections 352 of the support member 36 in order to resiliently engage the support member 36 with a locking member/ring 364, as best shown in FIGS. 11A-12 and 17-20. The locking member/ring 364 is formed essentially as a combination of the ring 120 and the locking member 132 of the prior embodiments. The locking member/ring 364 includes an interior member 366 having an outer periphery 368 from which extends an exterior member 370. The interior member 366 is formed with a central section 372. The central section 372 defines a central opening 373 that is positioned in alignment with the opening 48 in the support member 36 to enable the shaft 26 to extend therethrough. In addition, a number of inwardly extending teeth 375 are positioned around the periphery of the central opening 373, and a number of flanges 374 are disposed, preferably spaced equidistant from one another and formed to expand outwardly from the central section 372. The flanges 374 each include a tab 376 located along one side of the flange 374 adjacent the wide end of the flange 374. The tab 376 projects outwardly generally perpendicular to the flange 374 from each side of the flange 374. The portion of the tab 376 disposed adjacent the support member 36 functions in part to retain the spring 360 engaged with the flange in alignment with the flange 374, thereby maintaining constant engagement between the spring 360 an the flange 374 to bias the locking member/ring 364 away from the support member 36.

Opposite the central section 372, the wide ends of each flange 374 are each connected to an interior surface 378 of the exterior member 370. The exterior member 370 is generally cylindrical in shape, such that the interior member 368 is disposed completely within the exterior member 370. The flanges 374 and exterior member 370 define a number of spaces 380 therebetween which are disposed in alignment with the attachment members 50. The exterior member 370 has a sufficient inside diameter so as to be larger than the outside diameter of the rim 42 of support member 36, thereby allowing the support member to be positionable within the exterior member 370. In addition, the inside diameter of the exterior member 370 is sized such that the exterior member 370 is able to rotate freely about the circular rim 42 of support member 36 of device 10 with a minimal transverse motion such that the rim 42 of support member 36 axially locates the exterior member 370. Likewise, the exterior member 370 is free to translate axially along support member 36 under the bias of the springs 360 engaged between the support member 36 and the locking member/ring 364.

The exterior surface 382 of the exterior member 370 includes a number of raised portions 384 disposed therearound that enable the locking member/ring 364 to be easily grasped and rotated by an individual when in use. Further, at the end of the exterior surface 382 opposite the support member 36, the surface 382 includes a rim 386 extending axially from the circumference of the exterior surface 382 and on which is disposed indicia 387 relating to the particular gear ratios at which the tool 10 is operating.

As best shown in FIGS. 11A-12 and 21-24, instead of the cover 66, the tool 10 includes a plate member 388 positioned adjacent the locking member/ring 364 opposite the support member 36. The plate member 388 is formed of any suitable material and includes a central aperture 77 aligned with the opening 373 in the ring 364 to enable the shaft 26 to pass therethrough. Around the aperture 77 are disposed a number of equally spaced bores 78 alignable with the bores 52 in the attachment members 50 in the support member 36 and can receive the screws 80 used to affix the planetary gears 90 to the plate member 388. This, in turn, secures the plate member 388 to the support member 36, with the ring 364 movably positioned therebetween.

The plate member 388 also has a number of bores 392 disposed in between each pair of adjacent bores 78. The bores 392 are used to receive pins 393 therein that project through the spaces 380 in the plate member 388 and into engagement within the blind bores 52 hold the mechanism 344 together. In this manner, the rotation of the ring 364 is limited with regard to the support member 36 and plate member 388, and the end of the springs 360 opposite the projections 352 is maintained in engagement with the flanges 374 to provide a constant biasing force between the support member 36 and the locking member/ring 364.

Spaced from the aperture 77 on the exterior periphery of the plate member 388 are a number of stops 394. The stops 394 extend perpendicularly from the plate member 388 axially inwardly towards the ring 364. The stops 394 are preferably equidistantly spaced around the plate member 388 in alignment with and extending at least partially through the spaces 380 and include a first stop 396 and a second stop 398. The first stop 396 is formed to have a height less than that of the second stop 398, and is separated from the second stop 398 by a notch 400. The first stop 396 is additionally separated from the plate member 388 by a groove 402 formed in the plate member 388 immediately adjacent the first stop 396. The notch 400 and the groove 402 are formed to have a depth sufficient to receive and retain the tab 376, thereby holding the ring 364 at that position with respect to the support member 36 and the plate member 388.

Opposite the stops 396, 398, the plate member 388 includes a number of recesses 404 formed in the body of the plate member 388. The recesses 404 reduce the overall weight of the plate member 388 such that the tool 10 is easier to manipulate as desired.

Figure 26:
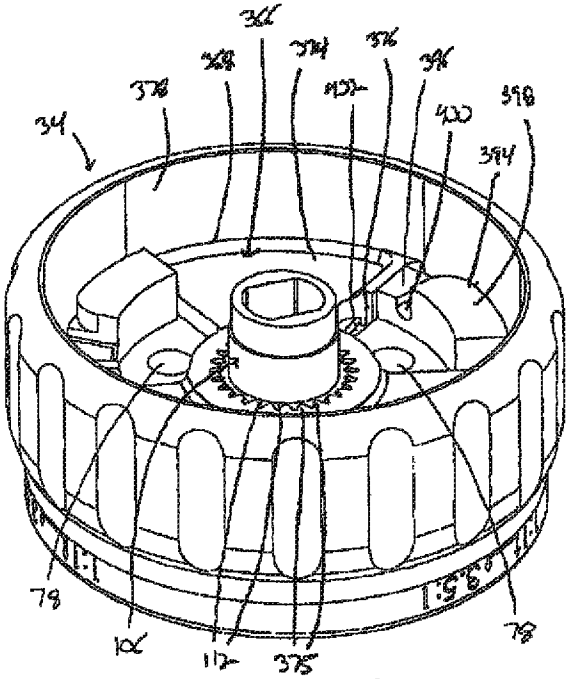
FIG. 26 is an isometric view of the locking member of FIG. 17 in an engaged position.
Figure 25:
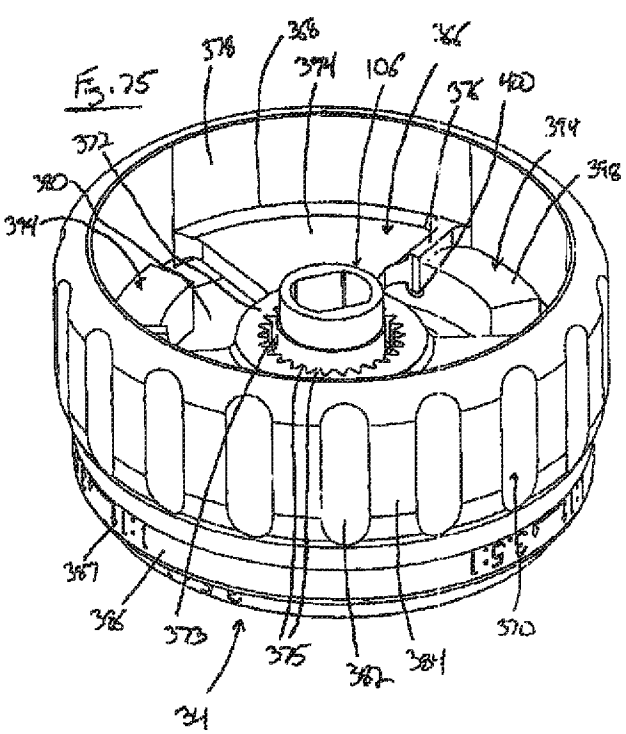
FIG. 25 is an isometric view of the locking member of FIG. 17 in a disengaged position.

In operation, to shift the gear ratio of the mechanism 34, the ring 364 is grasped and urged towards the handle 28 and support member 36. This motion disengages the tab 376 from within either the notch 400 or the groove 402 depending on the amount of movement of the ring 364. In this position, the ring 364 can then be rotated to align the tabs 376 with either the notch 400 or the groove 402. At that position, the ring 364 can be released, and the bias of the springs 360 will urge the tabs 376 into engagement with the notch 400 or the groove 402. When the tabs 376 are positioned in engagement with the notch 400, as best shown in FIG. 25, the teeth 375 within the central opening 372 are disengaged from the sun gear 106 on the shaft 26, such that the mechanism 34 operates in a ratio of other than 1:1, which can be selected as desired based on the number of teeth 94, 104, 112, on the respective gears 90, 100 and 106, but that is preferably selected to be a ratio of between 2:1 to 5:1, and more preferably a ratio of 3.5:1. Alternatively, when the tabs 376 are engaged within the grooves 404, as best shown in FIG. 26, the teeth 375 on the central section 372 of the interior member 366 of the ring 364 are engaged with the teeth 112 on the sun gear 106, such that the mechanism 34 operates in a ratio of 1:1.

A fourth embodiment of a tool or device constructed according to the present invention is indicated generally at 100' in FIGS. 27-30. The device 100' includes a handle 102', a gear housing 104' and a shaft housing 106'. The shape of the handle 102' and housings 104' and/or 106 can be made to have any desired and ergonomic configuration, and can be made of any suitable material or combination of materials, with a material that is both impervious to fluids and able to be sterilized in any conventional manner being especially preferred. Additionally, the material(s) forming one or more of the handle 102' and housings 104' and/or 106' can be selected from a material having the desired properties that can be molded around the other components used in the formation of the device 100'.

Referring now to FIGS. 27-29 and 31-33, the shaft housing 106' is formed as a generally cylindrical member 108' having an exterior surface 110', optionally formed of a suitable material, such as a silicone, as a separate member 111' from the housing 106', to be grasped by the user and a central passage 112' therein. The passage 110' permits a shaft 114' to pass therethrough. The shaft 114' is connected at one end to a secure shaft socket 116' disposed within a recess 118' at one end of the passage 112'. The socket 116' is sealingly engaged by a bearing 117' seated against a narrowed portion 121' of the recess 118', and extends outwardly from the recess 118'. The socket 118' includes a narrow end 119' having locking surfaces 119*a*' therein, and a wide end 120' in which is disposed a locking collar 122' and a spring 124' positioned between the socket 116' and the collar 122'. The collar 122' and spring 124' are held within the socket 118' by a cap 126' engaged with the wide end 120' of the socket 118' that enables the collar 122' to pass therethrough.

The arrangement of the socket 116', locking collar 122' and spring 124' operates to releasably and securely engage the implement (not shown) with the locking surfaces 119*a*' to hold the implement in alignment with the housing 106' while the implement is engaged with the device 100'.

Looking now at FIGS. 27-30 and 38-41, the gear housing 104' is positioned adjacent the shaft housing 106' opposite the socket 116' and recess 118' and encloses a gear mechanism 127'. The shaft 114' extends through the gear housing 104' includes a sun gear 128' mounted thereto. The sun gear 128' forms part of the gear mechanism 127', with the sun gear 128' affixed around the shaft 114' and engaged with a bearing 130' seated in a recess 129' of the housing 106' that is aligned with the passage 112' and disposed opposite the socket 116'. The sun gear 128' engages a number of planetary gears 132', i.e., at least one, or preferably two or more gears 132', that are rotatably mounted to a circular plate section 133' of a planetary gear body 134' by fasteners 136' inserted into bores 137'. The shaft 114' extends from the sun gear 128' through a channel 138' defined in a cylindrical portion 139' of the planetary gear body 134' extending outwardly from the plate section 133', while the sun gear 128' is engaged by a bearing 140' located within a recess 142' in the planetary gear body 134' concentrically aligned with the channel 138'.

Figures 46, 47:
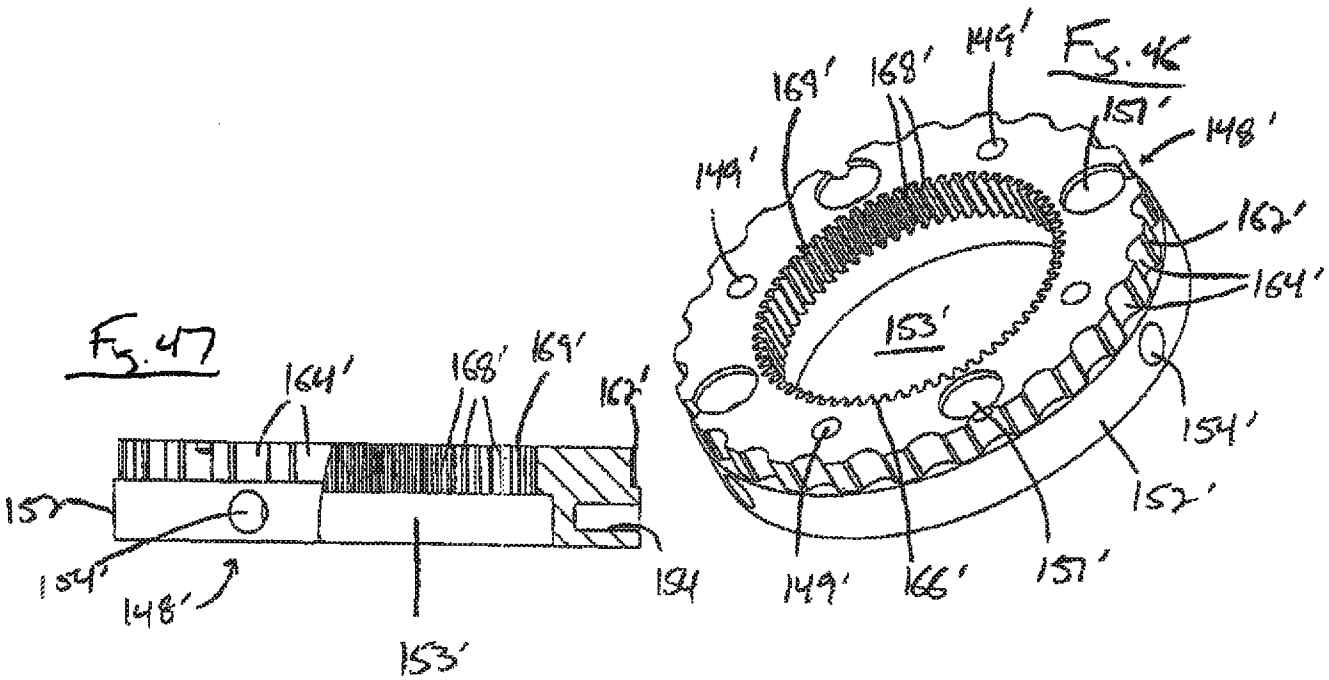
FIG. 46 is an isometric view of a ring gear of the device of FIG. 27.
FIG. 47 is a cross-sectional view of the ring gear of FIG. 46.

Disposed circumferentially around the recess 142' and planetary gears 132' are a number of roller bearings 144'. The bearings 144' are located within a raceway 146' formed adjacent the periphery of the plate section 133' of the planetary gear body 134'. These bearings 144' space the planetary gear body 134' from, and allow the planetary gear body 134' to move with respect to a ring gear body 148' secured to the housing 106' that includes indentations 149' to retain the bearings 144' stationary on the ring gear body 148', as best shown in FIGS. 46 and 47. The ring gear body 148' is attached to the shaft housing 106' by fasteners 150' extending through apertures 151' in the ring gear body 148' and defines a central opening 153' aligned with the passage 112' and channel 138' through which the shaft 114', sun gear 128' and planetary gears 132' extend. The ring gear body 148' includes a first portion 152' located adjacent the shaft housing 106' and including a number of radially extending blind bores 154' therein. These bores 154' receive springs 156' and detents 158' therein in a configuration that enables the springs 156' to continually bias the detents 158' outwardly from the bores 154'. The second portion 160' of the ring gear body 148' is formed with an exterior surface 162' having a number of grooves 164' thereon, and an interior surface 166' having a number of teeth 168' formed thereon to form a ring gear 169'. The teeth 168' are engaged with the planetary gears 132'.

The gear mechanism 127' is enclosed within the gear housing 104' by a selector collar 170', best shown in FIGS. 28 and 34-37. The collar 170' is generally cylindrical in shape and includes a radially inwardly extending wall 172'. The wall 172' defines an aperture 174' therein that corresponds in shape to the cross-sectional shape of the cylindrical portion 139' of the planetary gear body 134' in order to maintain the alignment of the collar 170' with the planetary gear body 134' and the shaft 114' passing therethrough (FIGS. 42-45). The cylindrical portion 139' and the aperture 174' can have any suitable shape, such as circular or polygonal cross-section, and in one embodiment has the shape shown in FIG. 38 of a generally circular interior section 171' with a number of outwardly projecting exterior sections 173' in which are each located the bores 137'.

In the portion of the collar 170' positioned around the gear mechanism 127', the interior surface 175' of the collar 170' includes a pair of peripheral locking tracks or grooves 176' located adjacent the ring gear body 148', a number of ridges 178' spaced axially inwardly from the grooves 176' and equidistant from one another around the circumference of the collar 170', and a number of vents 180' spaced from the notches 178' opposite the grooves 176' and extending through the collar 170'. The peripheral grooves 176' are shaped to engage and retain the spring-biased detents 158' from the ring gear body 148' therein to hold the collar 170' in the selected position with regard to the ring gear body 148'. The vents 180' allow for increased ease of flushing of various cleaning and sterilization fluids through the device 100'. The ridges 178' are formed such that they extend inwardly from the interior surface 175' of the collar 170' to engage the grooves 164' on the ring gear body 148' (FIGS. 48-49), but do not contact or otherwise interfere with the movement of the ring gear body 148' within the collar 170'.

Figure 50:
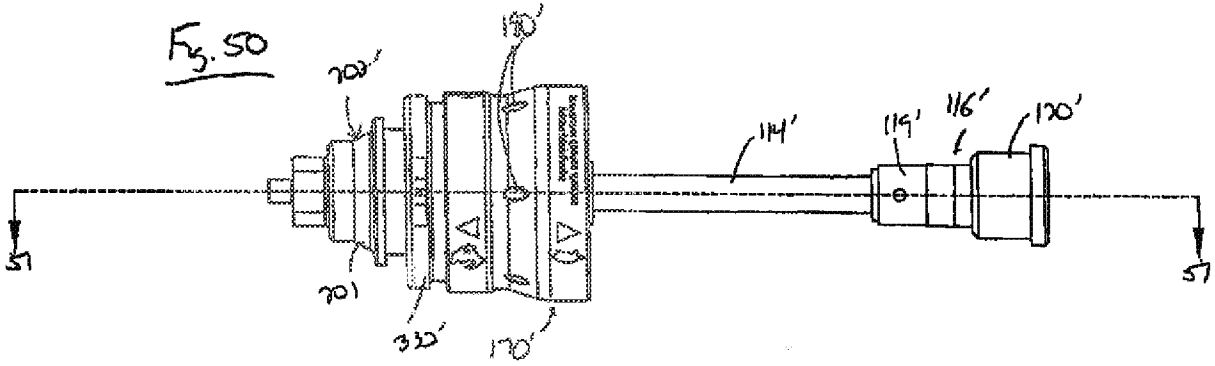
FIG. 50 is a side pan view of the driving mechanism of FIG. 30 in a disengaged position.
Figure 51:
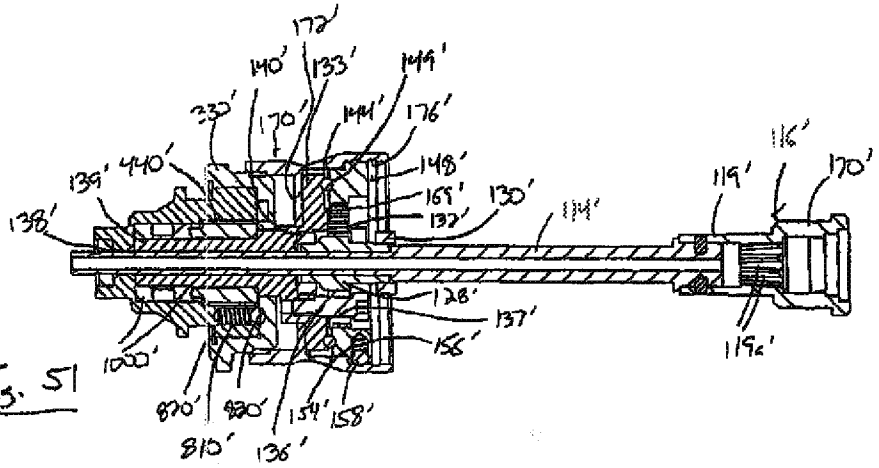
FIG. 51 is cross-sectional view along line 51-51 of FIG. 50.
Figure 52:
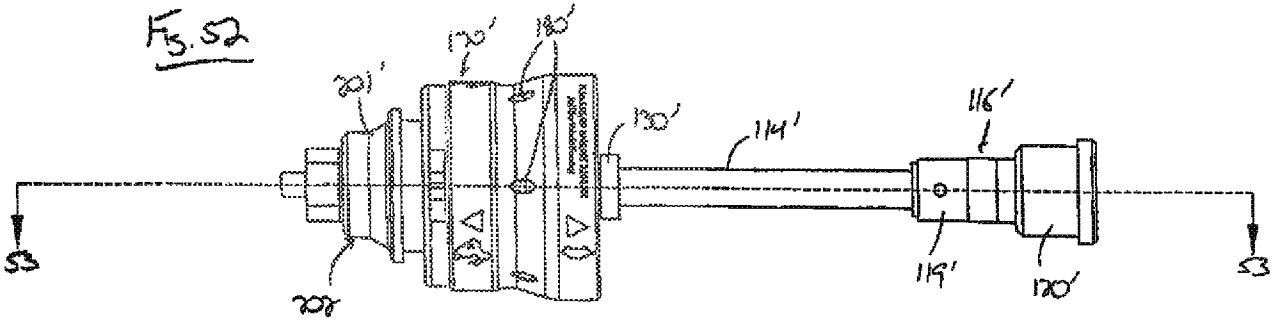
FIG. 52 is a side plan view of the driving mechanism of FIG. 30 in an engaged position.
Figure 53:
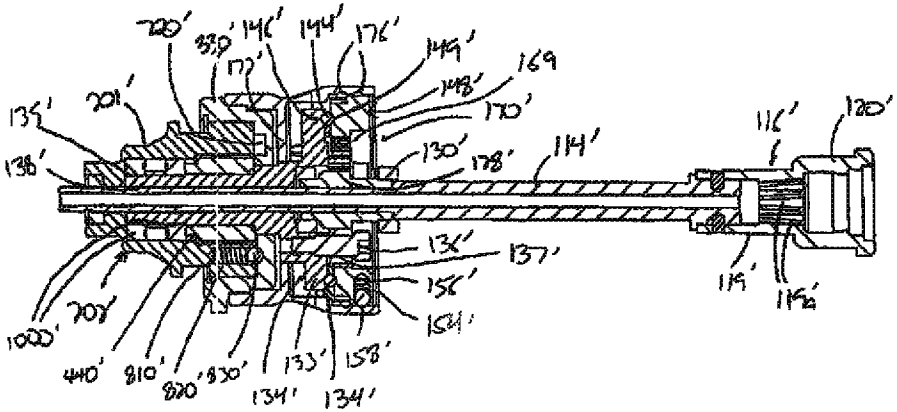
FIG. 53 is a cross-sectional view along line 53-53 of FIG. 52.
Figure 54:
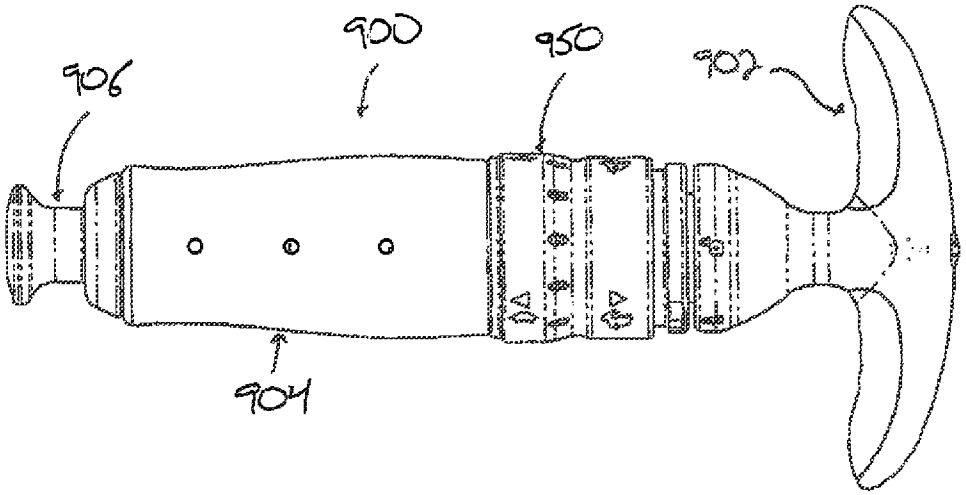
FIG. 54 is a top plan view of a fifth embodiment of a driving device constructed according to the present disclosure.

In operation, as best shown in FIGS. 50-51, in one position of the collar 170', the detents 158' are engaged with the inner groove 176' on the collar 170', such that the ridges 178' are engaged with the grooves 164' on the ring gear body 148'. In this configuration, the handle 102' is engaged with the shaft 114' via the planetary gear body 134', as well as via the collar 170' and the ring gear 169', such that the ratio of the gear mechanism 127' is 1:1 based on the direct engagement of the handle 102' to the shaft 114'. When it is desired to alter the gear ratio for the gear mechanism 127', the collar 170' is manually urged toward the handle 102'. This causes the bearing 158' to retract into the aperture 154' until the outer groove 176' is aligned with the aperture 154'. At this point the bearing 158' is urged outwardly into the outer groove 176' to hold the collar 170' in this position where the grooves 164' on the ring gear body 148' are disengaged from the ridges 178' on the collar 170'. As shown in FIG. 52-53, when the collar 170' is in this position, the collar 170' is disconnected from the ring gear 169', such that the handle 102' is only connected to the shaft 114' via the planetary gear body 134', so that the sun gear 128' is rotated at a ratio of other than 1:1, e.g. in excess of 1:1. The configuration of the teeth on the various gears 128', 132' and 169' in the mechanism 127' in the illustrated embodiment can be selected to enable the mechanism 127' to rotate the sun gear 128' at a ratio of between 0.5:1 to 3.5:1 with respect to the handle 102', or in excess of 1:1, with a ratio of 3.5:1 being preferred.

Figure 27:
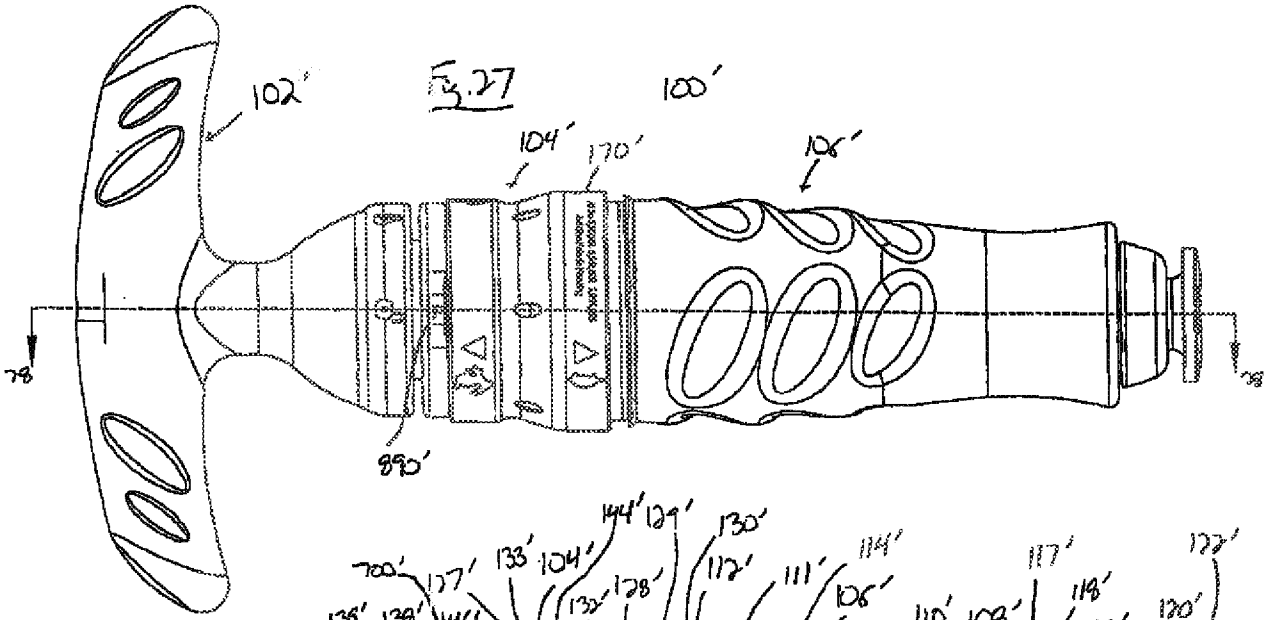
FIG. 27 is a side plan view of a fourth embodiment of the driving device constructed according to the present invention.
Figure 28:
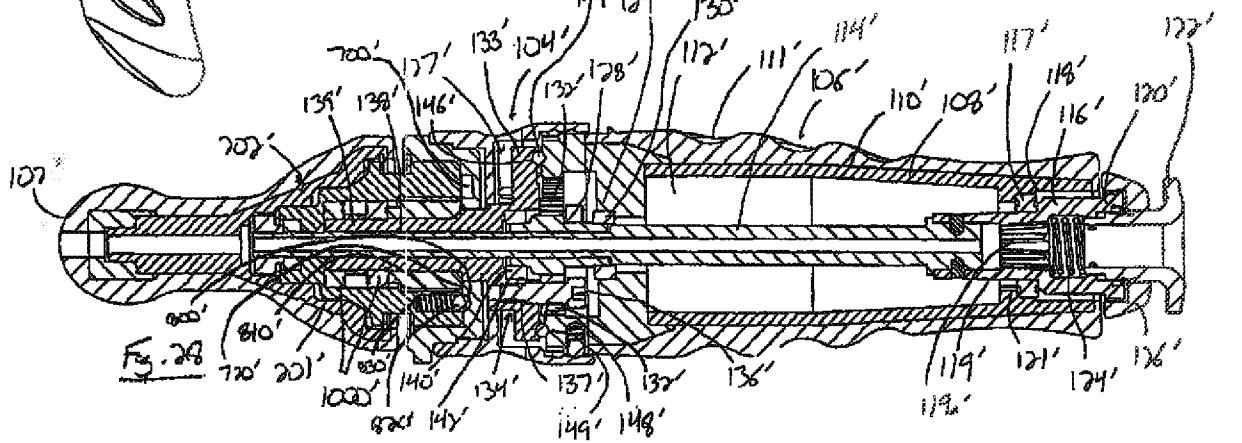
FIG. 28 is a cross-sectional view along line 28-28 of FIG. 27.
Figure 29:
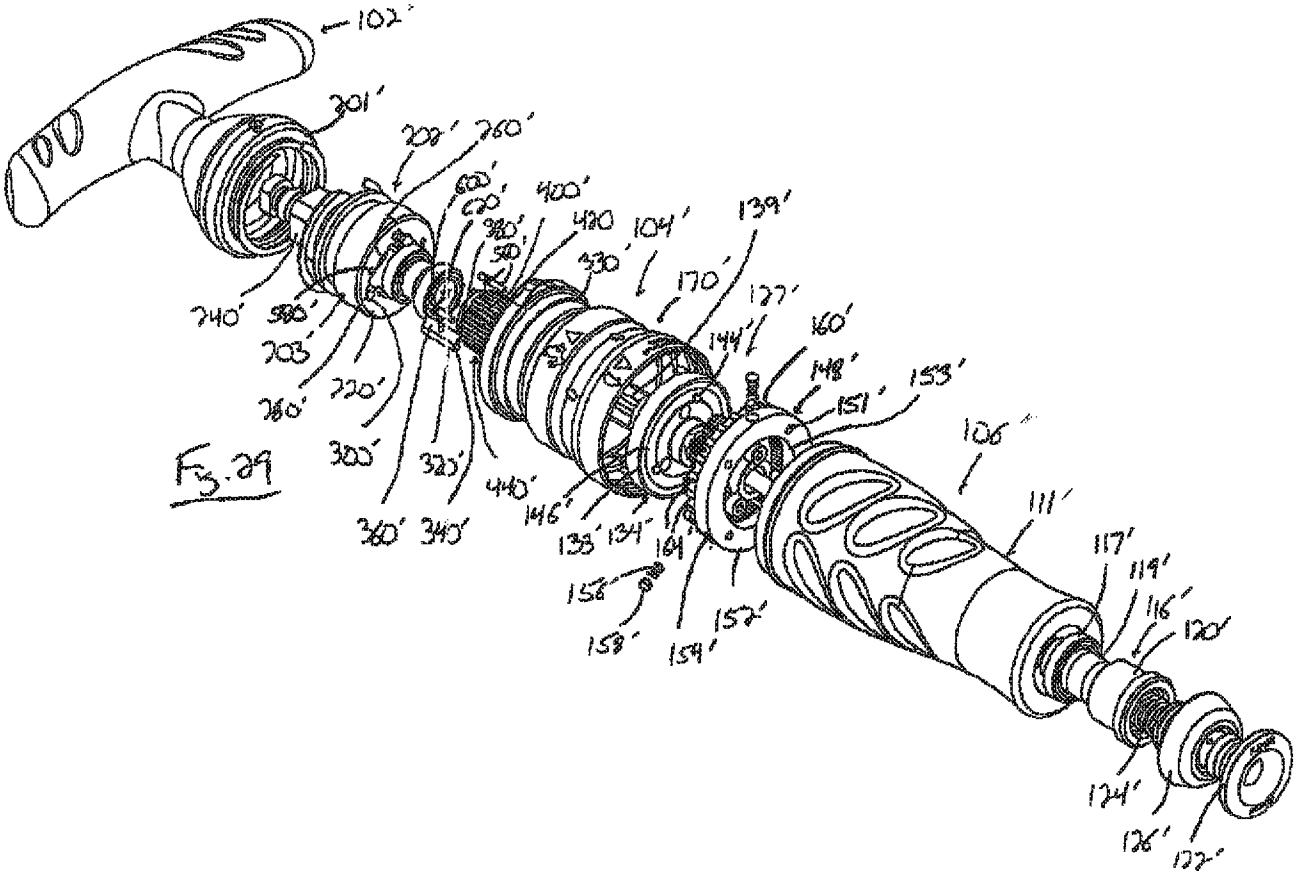
FIG. 29 is an isometric, exploded view of the device of FIG. 27.
Figure 30:
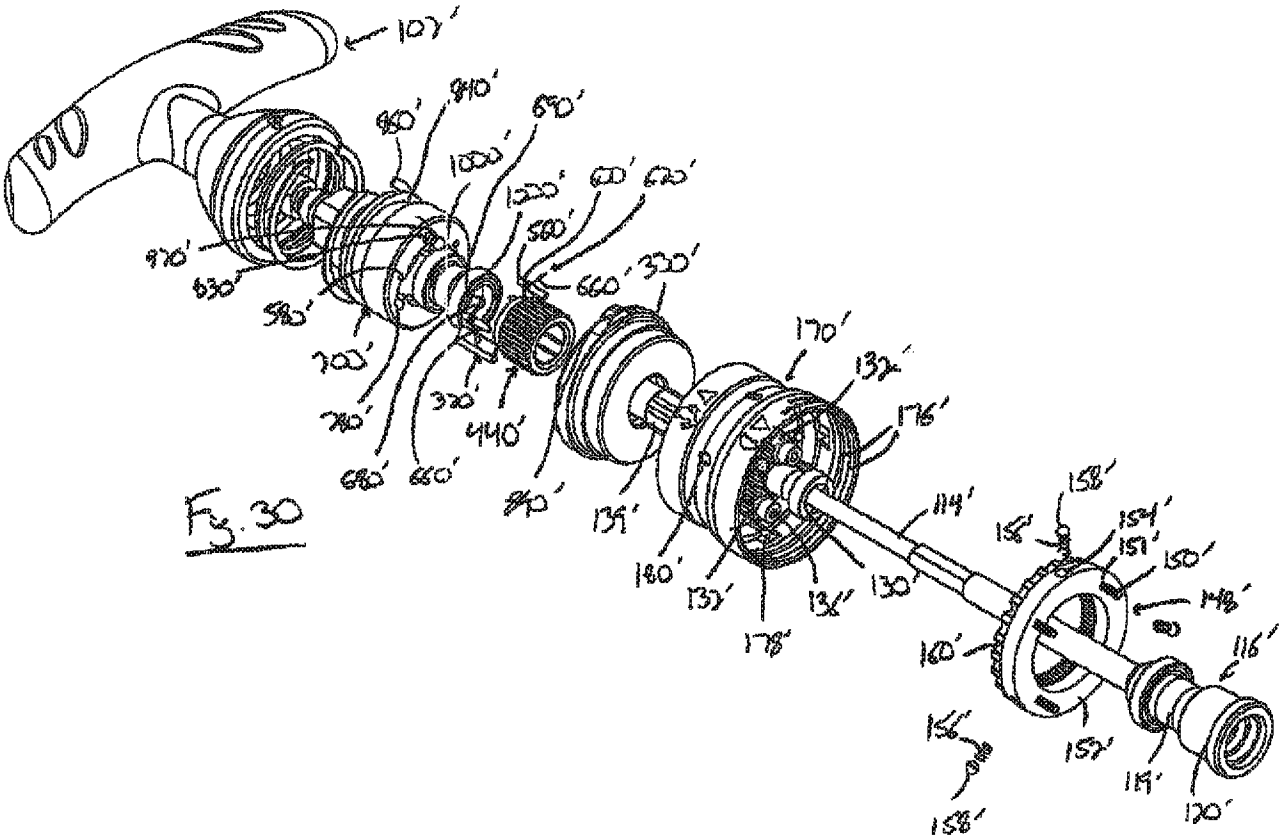
FIG. 30 is an isometric, exploded view of the driving mechanism of the device of FIG. 27.
Figure 31:
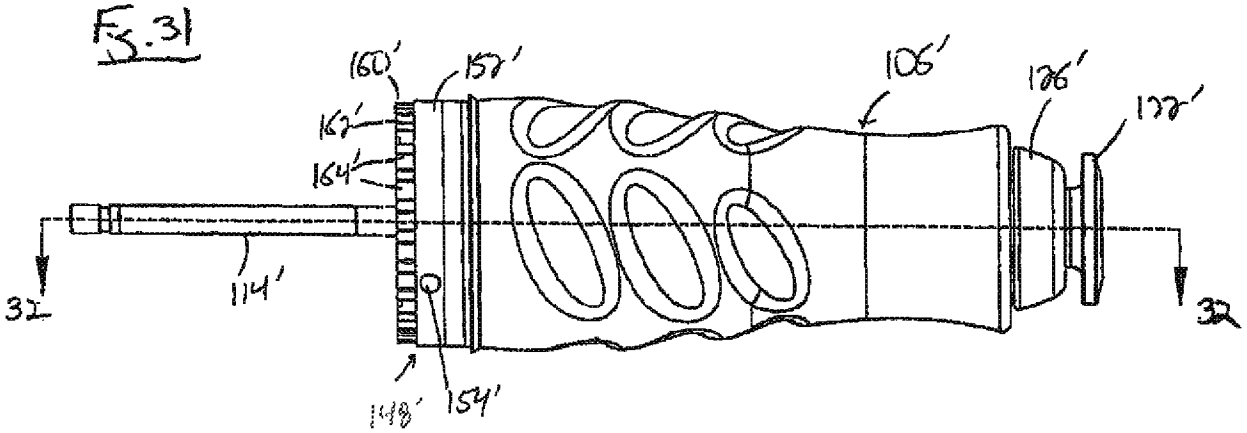
FIG. 31 is a side plan view of a secure shaft mechanism of the device of FIG. 27.
Figure 32:
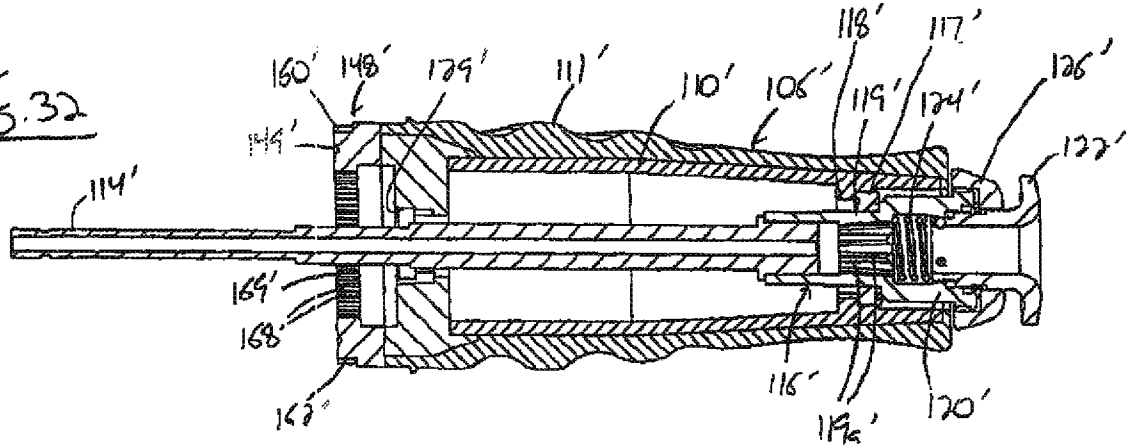
FIG. 32 is a cross-sectional view along line 32-32 of FIG. 31.
Figure 33:
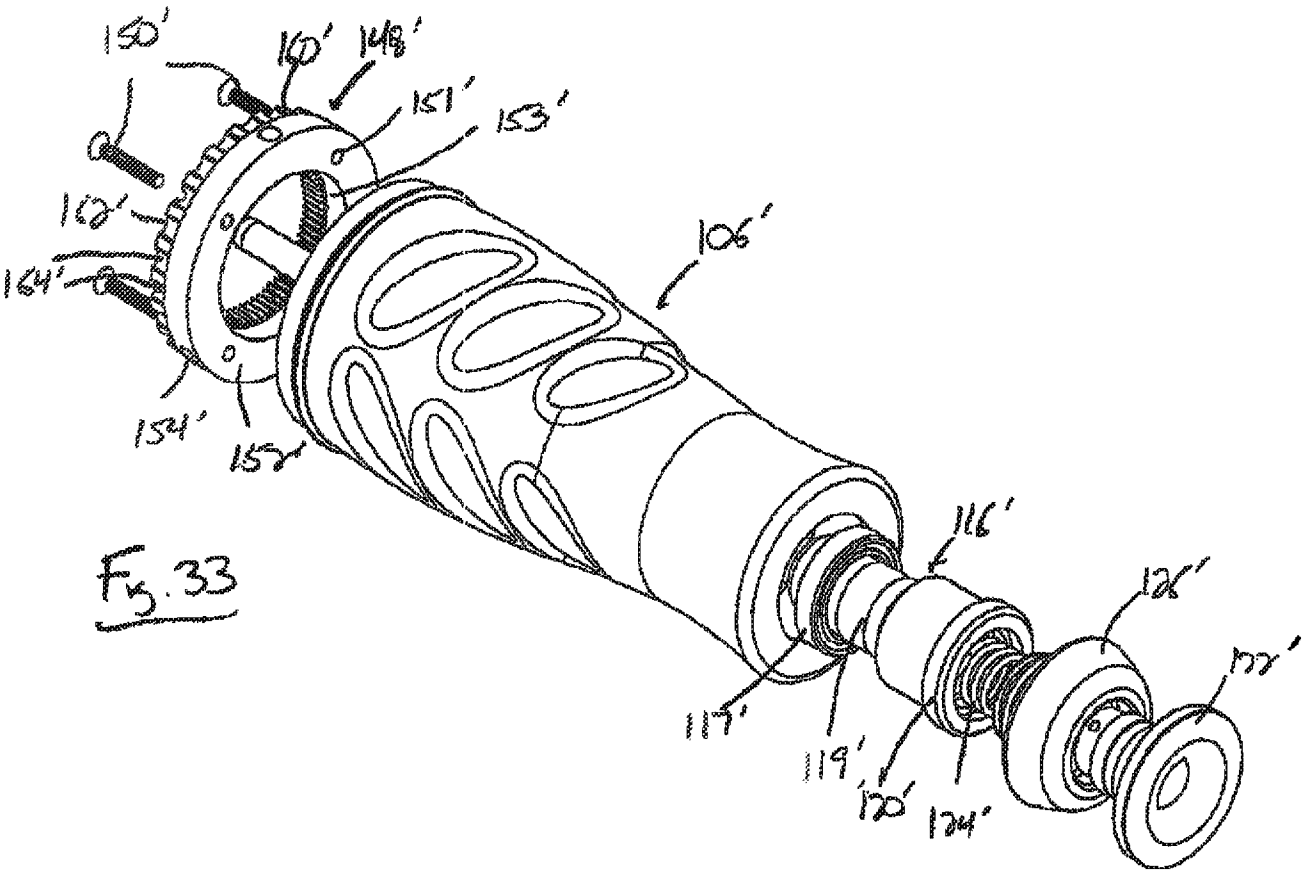
FIG. 33 is an isometric, exploded view of the secure shaft mechanism of FIG. 31.
Figures 34, 34A, 34B, 35, 36, 37:
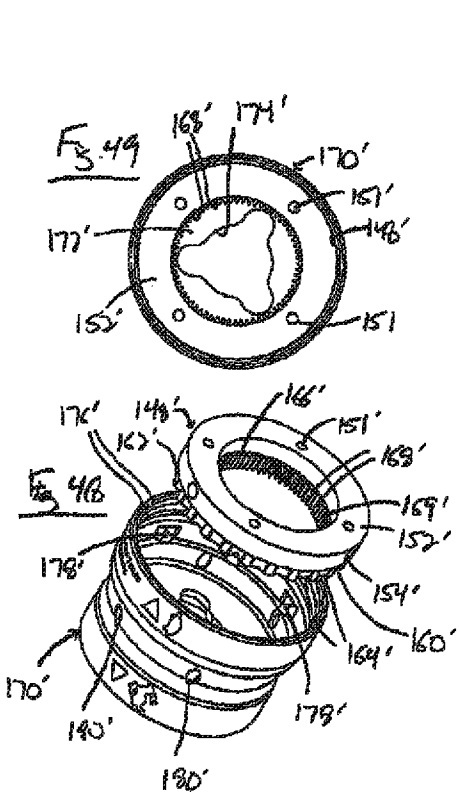
FIG. 34 is an isometric view of a locking collar of the device of FIG. 27.
FIG. 35 is front plan view of the locking collar of FIG. 34.
FIG. 36 is a rear plan view of the locking collar of FIG. 34.
FIG. 37 is a cross-sectional view along line 37-37 of FIG. 36.

Looking now at FIGS. 27-29, adjacent the gear housing 104', the handle 102' includes an insert 201' that receives a ratcheting mechanism 202' therein, such as that disclosed in co-pending and co-owned U.S. patent application Ser. No. 12/241,696, the entirety of which is expressly incorporated by reference herein in its entirety. The mechanism 202' can be fixed to the handle 102' using any suitable means, such as a mechanical fastener (not shown), an adhesive, or any suitable bonding technique such as thermal or sonic welding depending upon the types of materials used to form the handle 102' and the ratcheting mechanism 202'.

The mechanism 202' includes an enclosure 203' having a wide end 220' with a generally circular central opening 260' that extends inwardly into the enclosure 203' towards a narrow end 240'. A pair of elongate slots 280' is disposed on opposite sides of the opening 260' and extends generally radially and tangentially outwardly from the opening 260'. However, the slots 280' can also be offset from one another such that the slots 280' are not aligned or positioned as mirror images of each other. Each slot 280' defines a nesting portion 300' opposite the central opening 260' that is generally circular or arcuate in shape, and circumscribes an arc of greater than 180°. More preferably, the nesting portion 300' encompasses an arc of greater than 200° but not more than 250° to allow for sufficient movement within the portions 300'.

The shape of each nesting portion 300' is designed to pivotally receive and securely retain a pawl 320' therein. The pawls 320' are generally elongate members formed of a rigid material, such as a metal or hard plastic, that include a stem 340' having a generally circular cross-section and a diameter slightly less than the inner diameter of the nesting portion 300'. The pawls 320' further include an arm 360' extending outwardly from the stem 340' and having a length sufficient to extend from the nesting portion 300' through the remainder of the slots 280' and into the central opening 260'. The arm 360' is generally rectangular in shape and includes an outer end 380' that is positionable within the central opening 260'. The overall length of the pawl 320' is such that when the pawls 320' are inserted fully into each slot 280' within the enclosure 200', a portion of each pawl 320' is positioned outwardly of the enclosure 200' such that the pawls 320' can be engaged by a cap 330' in a manner to be described.

The outer end 380' of the arm 360' of each pawl 320' is positionable within the central opening 260' in order to engage one of a number of teeth 400' disposed on an outer surface 420' of a gear 440' rotatably disposed in the opening 260' on the cylindrical portion 139' of the planetary gear body 134'. The teeth 400' are formed of a size sufficient to enable the gear 440' to be rotated through an angle of about 10° in order to move the width of a single tooth 400'. Therefore, the size of the teeth 400' allows for very small movements of the gear 440' with respect to the enclosure 200' providing a "smooth" feel to the mechanism 202' so that a fastener engaged by the device 100' can be very precisely adjusted. Also, because the smaller size for the teeth 400' enables the teeth 400' to be positioned further from a central axis of the gear 440', less stress or force is applied directly to the interface of the pawls 320' and the teeth 400', lessening the chance of the pawls 320' slipping over the teeth 400'.

Figures 39, 42, 43, 44, 45:
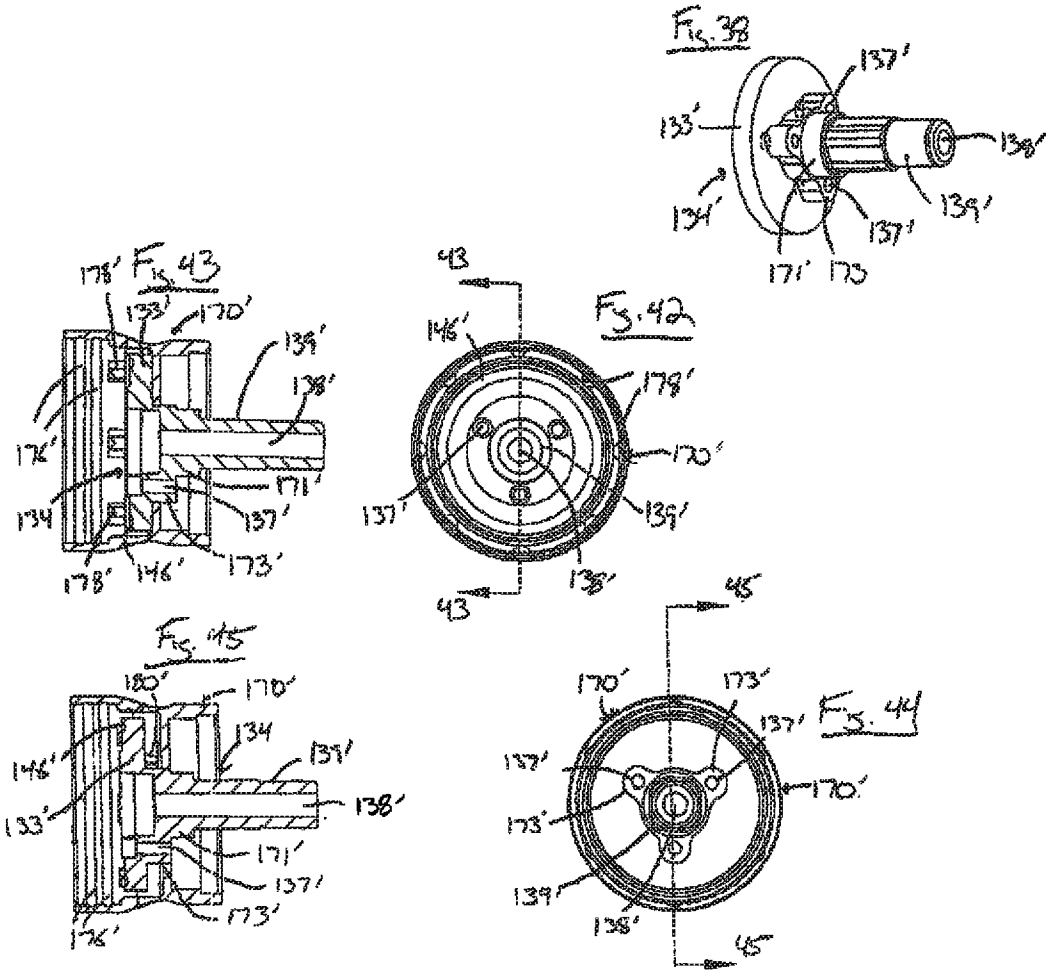
FIG. 39 is a side plan view of a sun gear and planetary gear body of the device of FIG. 27.
FIG. 42 is a front plan view of the locking collar engaged with the planetary gear body.
FIG. 43 is a cross-sectional view along line 43-43 of FIG. 42.
FIG. 44 is a rear plan view of the locking collar spaced from the planetary gear body.
FIG. 45 is a cross-sectional view along line 45-45 of FIG. 44.
Figure 39:
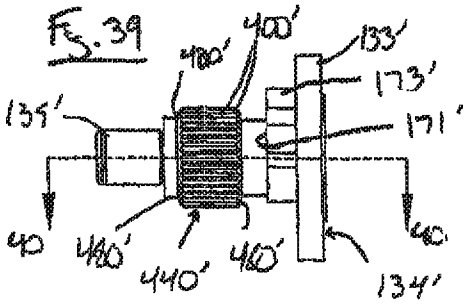
Figure 40:
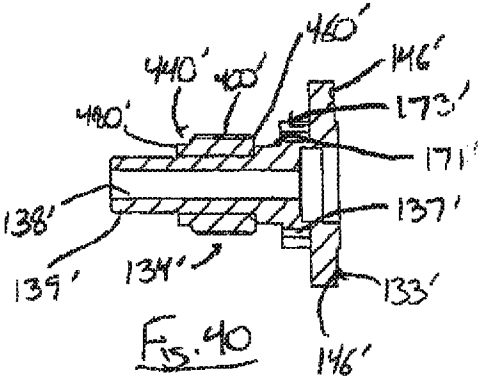
FIG. 40 is a cross-sectional view along line 40-40 of FIG. 39.
Figure 41:
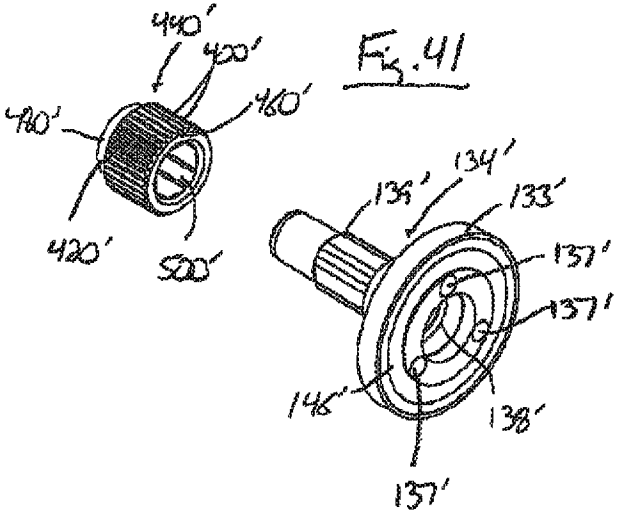
FIG. 41 is an isometric, exploded view of the sun gear and planetary gear body of FIG. 39.

The gear 440' is generally cylindrical in shape including a first section 460' of the outer surface 420' on which the teeth 400' are disposed, and a second section 480'. The outer diameter of the first section 460' of the gear 440' defined by the teeth 400' is slightly less than the inner diameter of the central opening 260', such that the gear 440' can rotate freely within the central opening 260' without interference from the enclosure 200'. The gear 440' further defines a central aperture 500' extending into and through the first portion 460', and that is shaped to be complementary to the shape of the cylindrical portion 139' of the planetary gear body 134' that extends through and is attached to the gear 440', as shown in FIGS. 39-41. The portion of the cylindrical portion 139' that extends into the enclosure 200' past the gear 440' is held in alignment with the handle 102' by bearings 1000' positioned within the enclosure 200' (FIG. 28) such that the cylindrical portion 139' and the gear 440' can rotate together when the tool 100' is in operation.

The gear 440' is effectively prevented from rotating within the central opening 260' of by the engagement of the pawls 320' with the teeth 400' on the gear 440'. The pawls 320' are biased into engagement with the teeth 400' by a pair of biasing members 540' disposed on opposite sides of the central opening 260' adjacent each slot 280'. Each of the biasing members 540' preferably includes a generally cylindrical pin 560' formed of a rigid material that is inserted into an elongate pin hole 580' located in the enclosure 200' adjacent each slot 280'. The length of each pin 560' is similar to the length of each pawl 320', such that when the pins 560' are inserted into the holes 580', the pins 560' extend outwardly from the enclosure 200' a short distance. It is also contemplated that only one biasing member 540' and pin 560' can be present.

Each pin 560' is inserted through a central, looped portion 600' of a torsion spring 620' in order to anchor the spring 620' within the enclosure 200'. While the spring 620' is a preferred biasing element for use in the biasing members 540', other suitable elements can also be used, such as a resilient, deformable plastic member, or a leaf spring, among others. To anchor the spring 620', the central section 600' is inserted into the pin hole 580' for engagement by the pin 560' through a channel 540' that extends between and intersects both the pin hole 580' and the slot 280'. Thus, a first leg 660' of the spring 620' is positioned along the channel between the pin hole 580' and slot 280', while a second leg 680' is biased outwardly by the central portion 600' and first leg 660' into engagement with the pawl 320'. The engagement of the second leg 680' with the pawl 320' maintains the outer end 380' of the arm 360' in engagement with the teeth 400' on the gear 440' to prevent rotation of the gear 440' in a direction toward the respective pawl 320'. Further, in a second embodiment of the spring 620', the first leg 660' and second leg 680' can be oriented on the central section 600' to extend outwardly from the central section 600' at an angle of approximately 90° with respect to one another. The increased angular distance between the first leg 660' and second leg 680' allows for an increase in the range and strength of the biasing force exerted by the spring 620' on the arm 380' of the pawl 320' to even further prevent slippage of the pawl 320' with respect to the teeth 400'. The first leg 660' may also include a tab 690' disposed opposite the central portion 600'. The tab 690' is insertable into an opening (not shown) in the channel 640' adjacent the nesting portion 300' of the slot 280' in order to ensure the proper positioning of the central portion 600' of the spring 620' within the pin hole 580' to allow easy insertion of the pin 560' through the central portion 600'.

The pawls 320' are maintained in or disengaged from the teeth 400' on the gear 440' by one of a pair of recesses 700' disposed on an interior surface 720' of the cap 330'. At least one of the recesses 700' has a wide end, and a narrow end that are separated by an inwardly extending ridge. The portion of each pawl 320' extending outwardly from the slots 280 is positioned within one of the recesses 700' on the cap 330' when the cap 330' is secured to the enclosure 200'. When the cap 330' is rotated over the enclosure 200' such that a ridge of one of the recesses 700' comes into contact with the adjacent pawl 320', the pawl 320' is urged out of the central opening 260' away from the teeth 400' against the bias of the biasing member 540' to a disengaged position. In this position, the gear 440' is allowed to rotate in a direction toward the disengaged pawl 320', as the opposite pawl 320' is configured to allow rotation in this direction, but to prevent any rotation in the opposite direction.

In order to assist an individual in properly positioning the cap 330' to enable the recesses 700' on the cap 330' to control the rotation of the gear 440' in one direction or the other, the cap 330' includes a number of depressions 800' disposed between the pair of recesses 700'. Each of the depressions 800' is engageable with a spring-biased detent 820' positioned on the enclosure 200' between the pin holes 580'. When the cap 330' is rotated, the detent 820' is compressed inwardly into an opening 810' disposed in the enclosure 200' that retains the detent 820' such that the cap 330' can rotate above the detent 820'. However when one of the depressions 800' is positioned in alignment with the detent 820', a spring 830' positioned within the opening 810' between the enclosure 200' and the detent 820' urges the detent 820' outwardly into engagement with the depression 800'. The cap 330' is thus held in this position until such time as a sufficient force is applied by an individual to the cap 330' to disengage the depression 800' from the detent 820'. Further, to prevent the cap 330' from being rotated past the outermost depressions 800', the wide end of each recess 700' is configured to engage the outwardly extending end of each pin 560' which functions as a stop for the rotation of the cap 330' with respect to the enclosure 200'.

The cap 330' can be rotatably secured to the exterior of the enclosure 200' in any conventional manner, but is preferably secured to the enclosure 200' by the engagement of a circumferential clip 840' disposed on the exterior of the wide end 220' of the enclosure 200' with a corresponding groove 860' disposed on the interior surface 720' of the cap 330'. The engagement of the clip 840' and the groove 860' enables the cap 330' to rotate with respect to the enclosure 200' as necessary without disengaging the cap 330' from the enclosure 200', unless desired. Further, by engaging the clip 840' within the groove 860', a central opening 880' defined in the cap 330' is positioned in alignment with the central aperture 500' of the gear 440'. Thus, the cap 330' is maintained in alignment with the shaft 114' and the other parts of the device 100'. Also, to assist in rotating the cap 330' as it nests within the collar 170' opposite the ring gear body 148', the cap 330' can be formed of any suitable material, such as a metal or a suitably rigid plastic, that can have added grip enhancements, such as a knob 890', or other high friction structures, or materials.

Referring now to FIGS. 54-70, a fifth embodiment of the driving device 900 of the present invention is illustrated. The device 900 is formed similarly to the prior embodiments with a handle 902 at one end, a housing 904 extending outwardly form the handle 902 and an implement-engaging end 906 opposite the handle 902.

Looking now at FIGS. 54-60, the device 900 includes a ratcheting mechanism 908 disposed within the handle 902 and extending into the housing 904, and a torque-limiting mechanism 910 (FIGS. 69-70) disposed within the housing 904. The ratcheting mechanism can be formed similarly to that disclosed and discussed previously, and the torque-limiting mechanism 910 can be formed similarly to that disclosed in co-owned U.S. Pat. No. 7,650,821, which is expressly incorporated herein by reference.

Figures 63, 64, 65, 66, 67, 68:
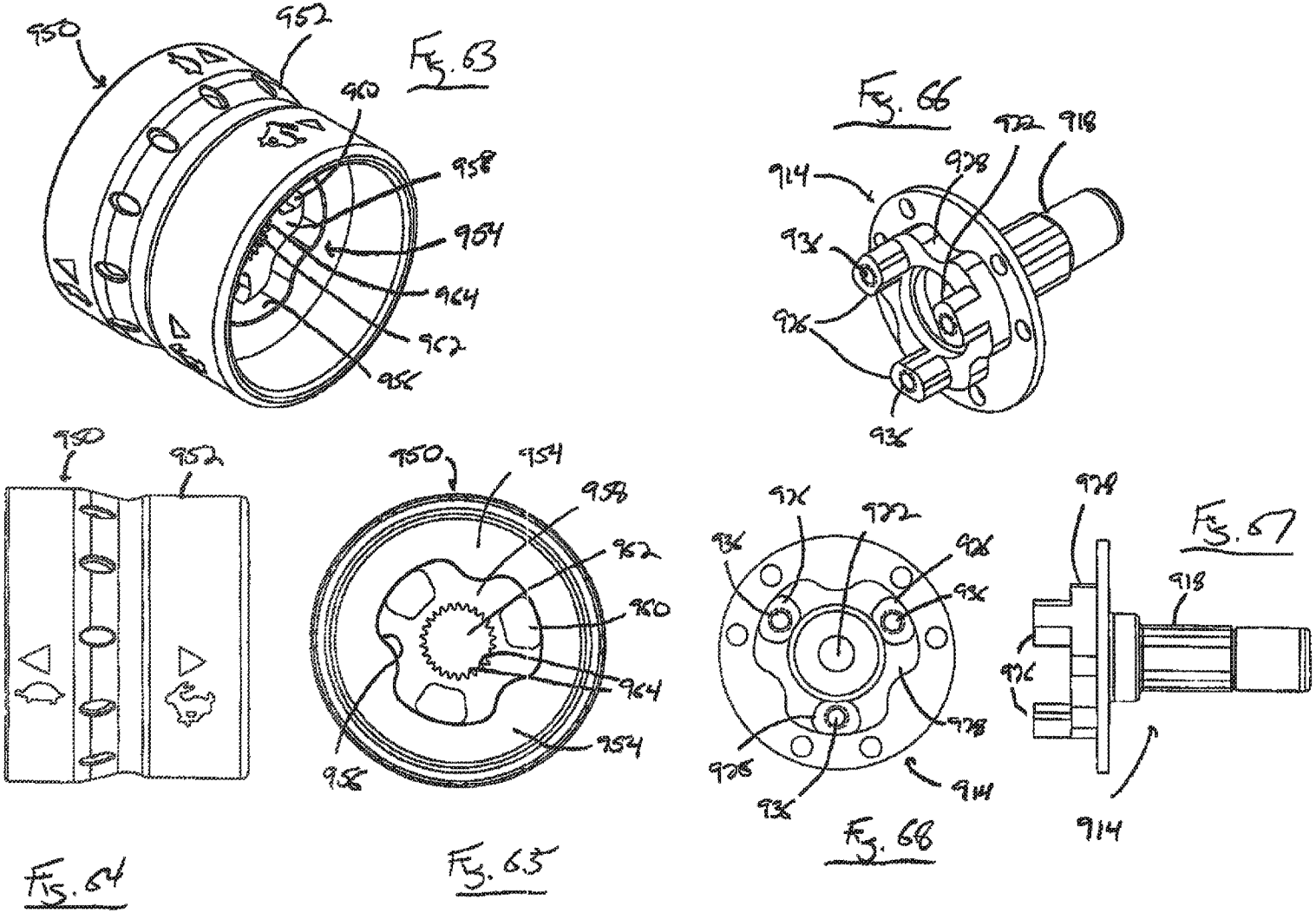
FIG. 63 is an isometric view of the locking collar of FIG. 61A.
FIG. 64 is a side elevation view of the locking collar of FIG. 63.
FIG. 65 is a front elevation view of the locking collar of FIG. 63.
FIG. 66 is an isometric view of the support member of the device of FIG. 60.
FIG. 67 is a front elevation view of the support member of FIG. 66.
FIG. 68 is a side elevation view of the support member of FIG. 66.
Figure 69:
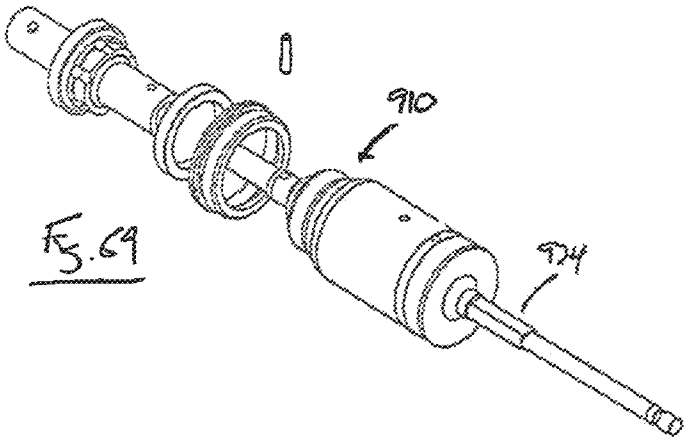
FIG. 69 is an exploded view of the shaft securing mechanism of the device of FIG. 60.
Figure 70:
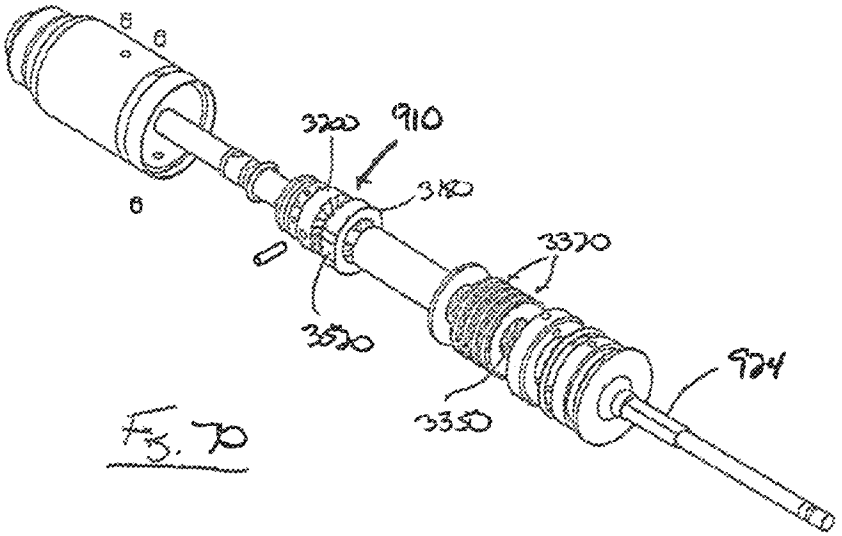
FIG. 70 is an exploded view of a torque limiting mechanism of the device of FIG. 60.
Figure 71:
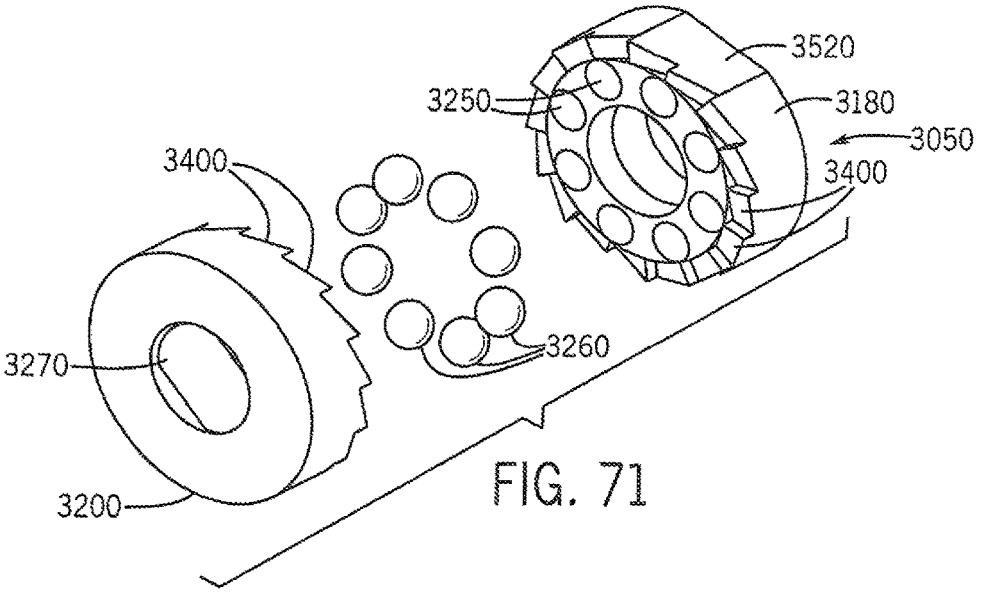
FIG. 71 is an isometric, exploded view of an embodiment of the torque-limiting mechanism utilized with the present invention.
Figure 72:
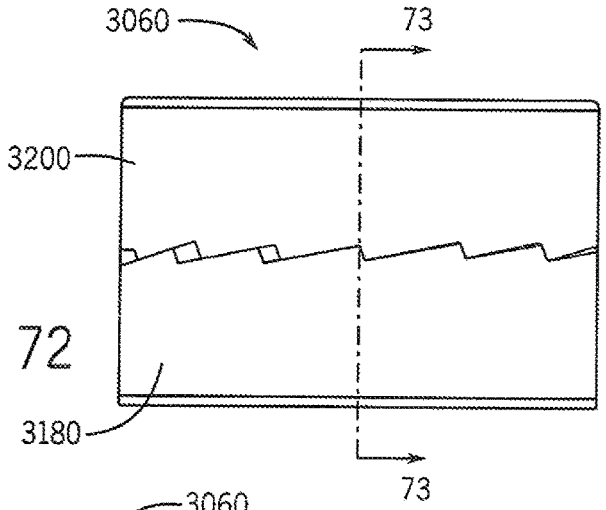
FIG. 72 is a side plan view of the mechanism of FIG. 71.
Figure 73:
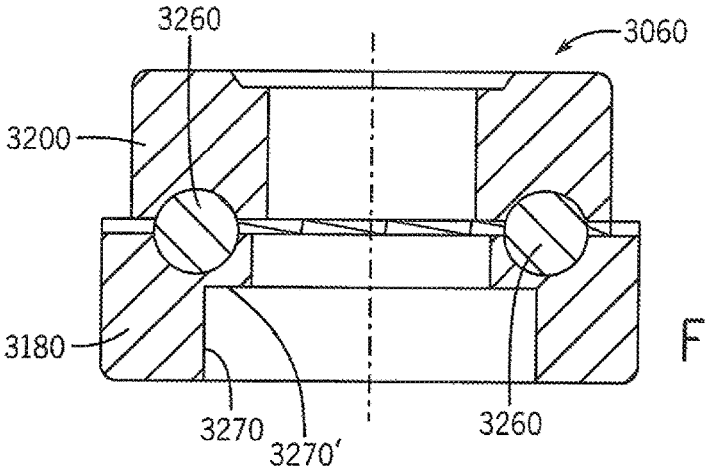
FIG. 73 is a cross-sectional view along line 73-73 of FIG. 72.
Figure 83:
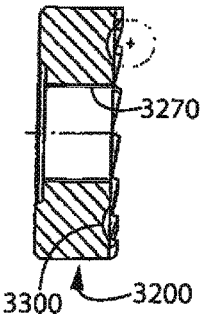
FIG. 83 is a cross-sectional view along line 34-34 of FIG. 82.
Figure 82:
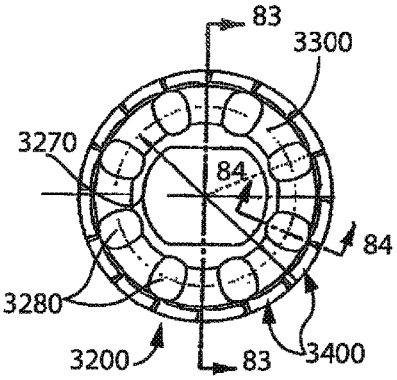
FIG. 82 is a top plan view of the slip gear of FIG. 80.
Figure 80:
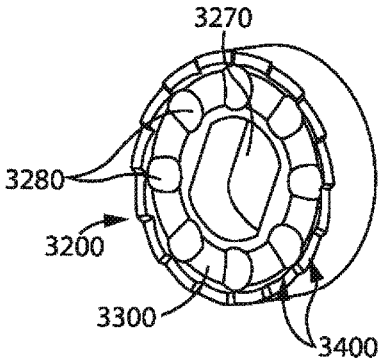
FIG. 80 is an isometric front view of a slip gear of the mechanism of FIG. 71.
Figure 81:
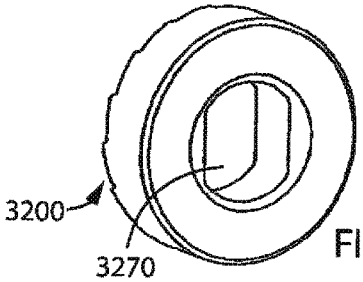
FIG. 81 is an isometric rear view of the slip gear of FIG. 80.
Figure 86:
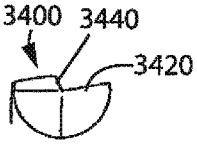
FIG. 86 is a partially broken away side plan view of a tooth on the slip gear of FIG. 85.
Figure 85:
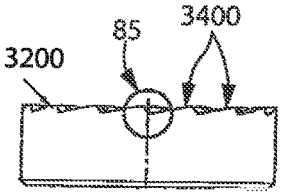
FIG. 85 is a side plan view of the slip gear of FIG. 80.
Figure 84:
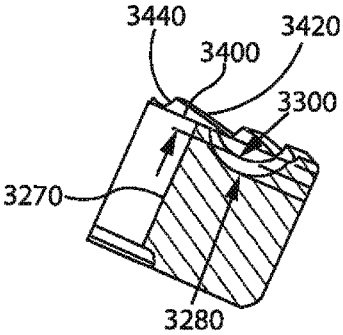
FIG. 84 is a cross-sectional view along line 35-35 of FIG. 82.
Figure 74:
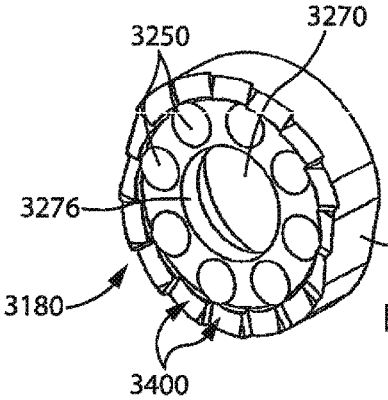
FIG. 74 is an isometric front view of a fixed gear of the mechanism of FIG. 71.
Figure 75:
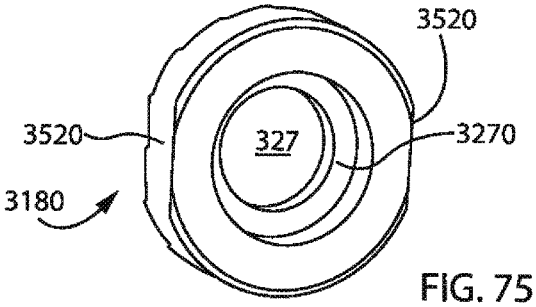
FIG. 75 is an isometric rear view of the fixed gear of FIG. 74.
Figure 76:
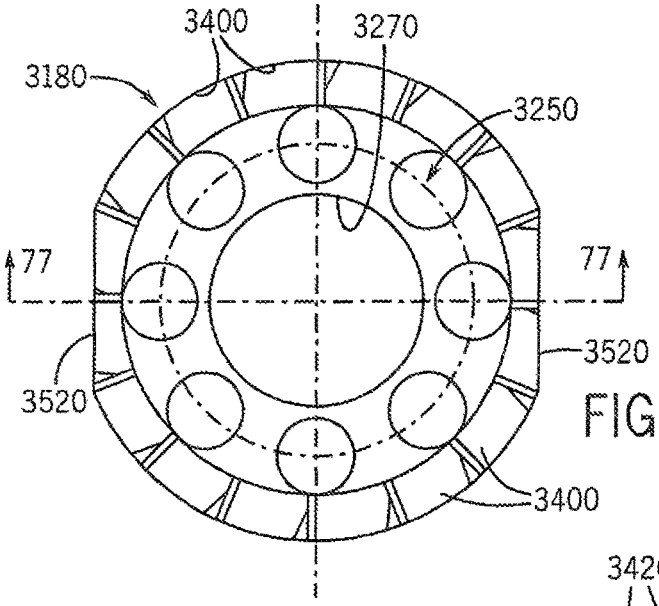
FIG. 76 is a top plan view of the fixed gear of FIG. 75.
Figure 77:
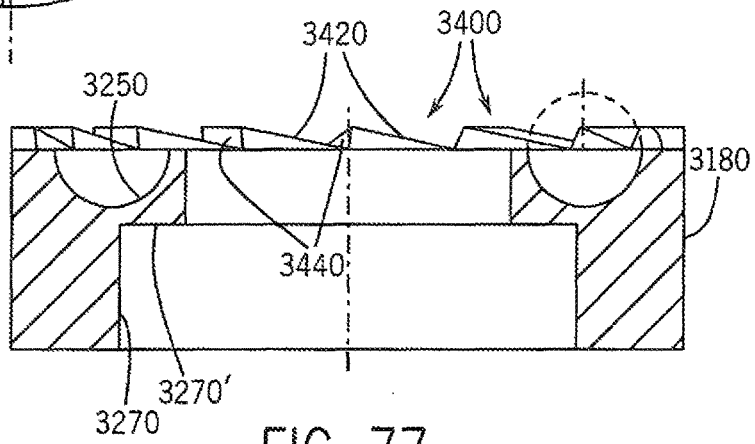
FIG. 77 is a cross-sectional view along line 77-77 of FIG. 76.
Figure 78:
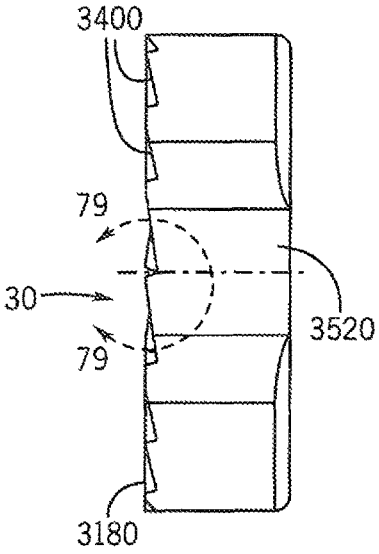
FIG. 78 is a side plan view of fixed gear of FIG. 74.
Figure 79:
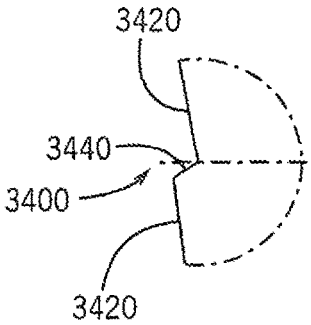
FIG. 79 is a partially broken away side plan view of a tooth of the fixed gear of FIG. 78.

Referring now to FIGS. 56, 58-59 and 61A-68, between the ratcheting mechanism 908 and the torque-limiting mechanism 910 is disposed a gear ratio switching mechanism 912. The mechanism 912 is formed similarly to the embodiment shown in FIGS. 27-53, and includes a support member 914 having a rearwardly extending projection 918 on which the gear 920 for the ratcheting mechanism 908 is mounted, as best shown in FIGS. 66-68. The projection 918 includes a central passage 922 that extends through the entire support member 914 and through which the main shaft 924 extends for connection to the handle 902 at one end and for engagement with the torque-limiting mechanism 910 at the opposite end.

Opposite the rearwardly extending projection 918, the support member 914 includes a number of attachment members 926. The attachment members 926 extend outwardly from a plate section 928 that surrounds the passage 922 and spaces the attachment members 926 from the remainder of the support member 914.

In turn, looking now at FIGS. 56 and 58-60, the attachment members 926 function to space a retaining ring 930 outwardly from the plate section 928 of the support member 914. The ring 930 is secured to the attachment members 926 by suitable fasteners 932 extending through apertures 934 in the ring 930 and into blind bores 936 in the attachment members 926. In this configuration, the ring 930 defines a space 938 between the ring 930 and the support member 914, and in particular the plate section 928.

The ring 930 also includes a number of bores 940 to which the planetary gears 916 are rotatably secured by fasteners 939 in a location opposite the space 938. In this position, the gears 916 can engage a ring gear 942 attached to the housing 904 and a sun gear 943 disposed on the shaft 924 in the desired manner to operate the device 900 at the selected gear ratio. Also, the peripheral edge 944 of the ring 930 operates to hold a number of bearings 946 in a groove 948 disposed in an exterior surface of the ring gear 942 to facilitate the movement of the ring gear 942 with regard to the planetary gears 916 and sun gear 943.

The mechanism 912 also includes a collar 950 disposed around the support member 914 and retaining ring 930, as best shown in FIGS. 63-65. The collar includes an outer enclosure 952 that is generally cylindrical in shape, and an inner web 954. The inner web 954 extends across the interior of the outer enclosure 952 and is seated in the space 938 defined between the support member 914 and the retaining ring 930. The web 954 includes a central recess 956 having a peripheral shape corresponding to, but slightly larger than the configuration of the plate section 918 of the support member 914, such that the recess 956 can be positioned around the plate section 918. The recess 956 maintains the alignment of the collar 950 with the support member 914, such that the collar 950 does not rotate with respect to the support member 914, but only moves axially with regard to the support member 914.

In addition, within the recess 956 the web 954 includes an inner web 958 extending across the area defined by the recess 956. The inner web 958 defines a number of apertures 960 shaped to correspond in shape to and be slightly larger than the attachment members 926, as well as a central opening 962 that is generally circular in shape with a number of teeth 964 disposed around the periphery of the opening 962.

The shape and location of the apertures 960, as well as the recess 956, enables the web 954 to move axially with regard to the support member 914 while maintaining the alignment of the web 954 with the support member 914.

Figure 61A:
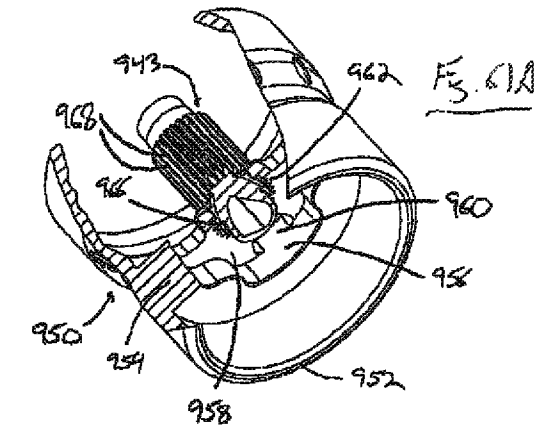
FIGS. 61A-B are partially broken away views of the locking collar of the device of FIG. 60 in a disengaged position.
Figure 61B:
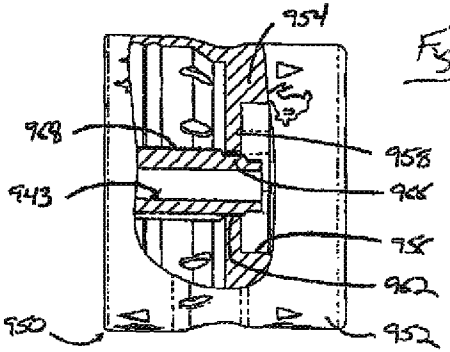

The teeth 964 formed in the central opening 962 are shaped to be able to engage the teeth on the sun gear 943 which extends into the opening 962. The sun gear 943 is formed with a reduced diameter section 966 adjacent the web 954, with the teeth 968 on the sun gear 943 being disposed immediately adjacent the reduced diameter section 966. Thus, the collar 950 can be axially moved/slid from a disengaged position, as shown in FIGS. 61A-61B, where the teeth 964 are spaced from the teeth 968 on the sun gear 943 to provide a increased gear ratio for the operation of the device 900, to the position in FIGS. 62A-62B, where the teeth 964 are engaged with the teeth 968 to provide a gear ratio of 1:1 for the device 900.

Figures 55, 56, 57, 58, 59:
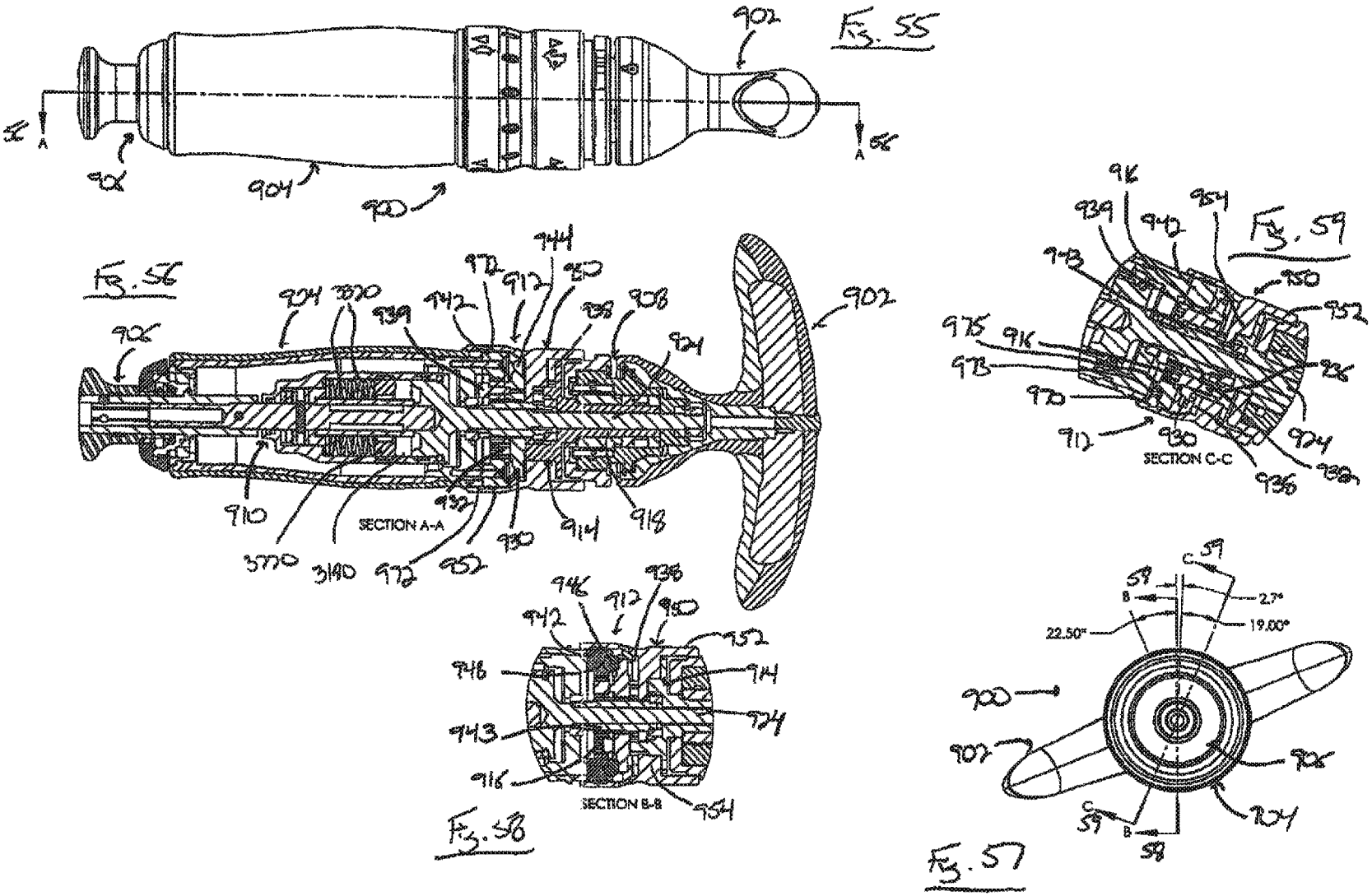
FIG. 55 is a side plan view of the device of FIG. 54.
FIG. 56 is a cross-sectional view along line 56-56 of FIG. 55.
FIG. 57 is a front elevation view of the device of FIG. 54.
FIG. 58 is a cross-sectional view along line 58-58 of FIG. 57
FIG. 59 is a cross-sectional view along line 59-59 of FIG. 57.
Figure 60:
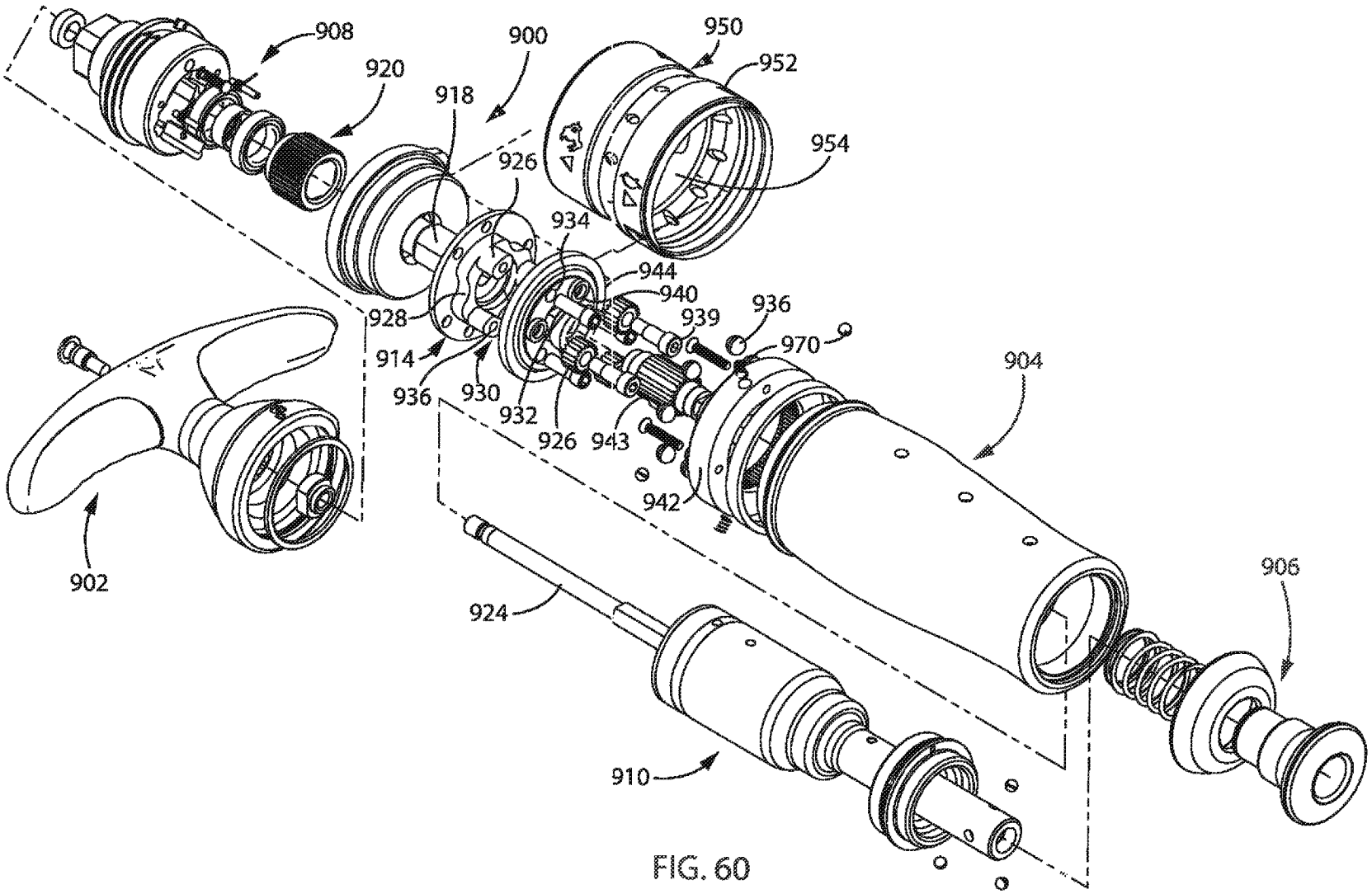
FIG. 60 is an exploded view of the device of FIG. 54.
Figure 60A:
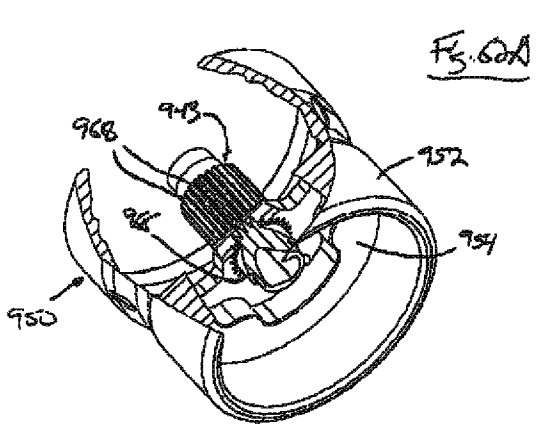
Figure 60B:
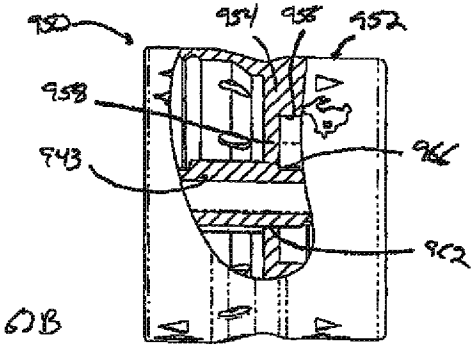

The collar 950 is retained in either the engaged or disengaged position through the engagement of one or more spring-biased detents 970 disposed in the ring gear 942, as best shown in FIGS. 59 and 60. Each detent 970 extends radially outwardly from the ring gear 942 and is releasably engaged with one of a pair of grooves 972 formed on the inner surface 974 of the enclosure 952. When a sufficient force is exerted on the collar 950 to move the collar 950 between the engaged and disengaged positions, the force compresses the detent 970 into the ring gear 942 until the detent 970 is aligned with the desired groove 972, where the detent is urged outwardly into the aligned groove 972 by a spring 973 positioned within a corresponding radial bore 975 in the ring gear 942 to hold the collar 950 in that position during the operation of the device 900.

In addition, the output from the gear ratio switching mechanism 912 via the shaft 924 connected to and extending through the sun gear 943 is transmitted to the torque-limiting mechanism 910 disposed within the housing 904, such that the torque-limiting mechanism 910 forms an axial extension of the shaft 924 for transmission of the operation of the device 900 to an implement and fastener engaged by the device 900. Examples of suitable torque-limiting mechanisms 910 are disclosed in U.S. Pat. No. 7,650,821, which is expressly incorporated by reference herein in its entirety. As shown in FIGS. 69-86, the torque-limiting mechanism 910 for use in a tool 900 is illustrated. In this mechanism 910, a fixed gear 3180 and a slip gear 3200 that provide the torque-limiting function to the mechanism 910 are formed of a rigid material and positioned adjacent to one another as described previously with regard to mechanism 910. The fixed gear 3180 includes a number of dimples 3250 spaced around a central opening 3270 in the gear 3180 on one surface of the fixed gear 3180. The opening 3270 can be cylindrical or can define an annular shoulder 3270' therein to assist in the formation of the dimples 3250. A number of spherical ball bearings 3260 are disposed within the dimples 3250 and are able to rotate therein. The depth of the dimples 3250 in the gear 318 are preferably sufficient to receive approximately one-half of the volume of each bearing 3260 such that while the bearings 3260 can rotate within the dimples 3250, the bearings 3260 are each maintained within the dimples 3250. In a particularly preferred embodiment, the bearings 3260, which are formed of a rigid and smooth material, such as a metal, formed to have a diameter slightly less than the diameter of the dimples 3250. This allows the bearing 3260 to rotate more freely within the dimples 3250 when the mechanism 910 is in use. The gear 3180 also preferably includes a pair of flats 3520 formed on opposite sides of the gear 3180 that are engageable with the tool housing 904 to maintain the position of the gear 3180 within the housing.

The rotatable or slip gear 3200 is formed similarly to the fixed gear 3180 with a central opening 3270 and a number of dimples 3280 spaced around the opening 3270 on one side of the gear 3200 that are positioned to face the dimples 3250 in the fixed gear 3180. The dimples 3280 receive the end of each of the bearings 3260 extending outwardly from the dimples 3250 in the fixed gear 3180, but are less deep than the dimples 3250 in the fixed gear 3180. The slip gear 3200 also includes an arcuate raceway 3300 extending around the surface of the gear 3200 along a circular centerline between the dimples 3280. During operation of the mechanism 910, the bearings 3260, while retained in dimples 3250 on the fixed gear 3180, can move along the raceway 3300 in order to displace the bearings 3260 between the respective dimples 3280 on the slip gear 3200 as the slip gear 3200 rotates with respect to the fixed gear 3180 when a torque level above a pre-selected maximum as applied to the tool 900.

To provide the torque level control for the mechanism 910, the fixed gear 3180 and slip gear 3200 are biased into engagement with the bearings 3260 and one another by a number of biasing members or springs 3320. The springs 3320 can each be formed from any suitable biasing member or material, but are preferably formed as Belleville washers and are disposed within the housing 904. Each spring 3320 is generally circular in shape with a central opening 3350 through which the drive body 924 can extend and are disposed within the housing 904 against the fixed gear 3180 opposite the slip gear 3200. The springs 3320 can be selectively compressed into engagement with one another and with the fixed gear 3180 in order to provide the desired amount of force resisting the rotation of the gears 3180, 3200 and the bearings 3260 with respect to one another during use of the tool 900.

In order to provide additional resistance control to the movement of the slip gear 3200 with regard to the fixed gear 3180, each of the fixed gear 3180 and the slip gear 3200 includes teeth 3400 positioned on the outer periphery of the gears 3180 and 3200. The teeth 3400 are spaced equidistant from one another around the periphery of each gear 3180 and 3200 in a form so as to be positioned in a locking engagement when the gears 3180 and 3200 are assembled, as best shown in FIGS. 71-86. In this configuration, the teeth 3400, which each include a sloped friction surface 3420 and a locking surface 3440, oppose the rotation of the slip gear 3200 with regard to the fixed gear 3180 by the frictional engagement of the sloped surfaces 3420 and vertical surfaces 3440 of each of the teeth 3400. The locking surfaces 3440 of the teeth 3400 are formed to be inclined from the vertical at an angle of between ten degrees (10°) to twenty-five degrees (25°), and preferably around fifteen degrees (15°), similar to the angle for the friction surfaces 3420 from the horizontal. The angle of the locking surfaces 3440 allow the teeth 3400 to slip more easily with regard to one another and prevent the snapping and vibrations caused by prior art gears.

Additionally, the formation of the teeth 3400 including the locking surface 3440 on each of the gears 3180 and 3200 provides a one-way rotational or ratcheting function for the mechanism 910. In other words, due to the positioning of the locking surfaces 3440 on each gear 3180 and 3200, when the slip gear 3200 is rotated in a direction which contacts locking surfaces 3440 of teeth 3400 on each gear 3180 and 3200 with one another, the contact between the locking surfaces 3440 prevents any further rotation of the slip gear 3200 in this direction. However, rotation in the direction moving the locking surfaces 3440 away from one another is permitted by the construction of the mechanism 910. Additionally, it is also contemplated that the fixed gear 3180 and the slip gear 3200 can be formed without the teeth 3400, such that the mechanism 910 can be operable in either direction, with any ratcheting function for the tool 900 provided by a separate mechanism.

Other embodiments are also contemplated, such as a device 100' without a ratcheting mechanism 202', a device

100' including a suitable torque-limiting and/or torque measuring device, and a device 100' having a gear mechanism 127' that is other than a planetary gear system for transmitting the rotational motion from the handle 102' to the shaft 114'. In addition, the device 100' can formed with the collar 170' in a locked position to maintain the device permanently in either the 1:1 or altered gear ratio.

Various other alternatives are contemplated is being within the scope of the following claims particularly pointing out and distinctly claiming the subject matter regarded as the invention.

We claim:

1. A driving tool comprising:

a) a housing having an open end;

b) a shaft operably connected to the housing and disposed at least partially within the open end;

c) a gear assembly at least partially disposed within the housing and engaged with the shaft;

d) a gear ratio switching mechanism engaged with the gear assembly; the switching mechanism including a collar slidably disposed along an exterior of the housing to slide in a linear axial direction with regard to the gear assembly and a number of teeth disposed on the collar and selectively connected to the gear assembly; and e) at least one of a ratcheting mechanism or a torque limiting mechanism at least partially disposed within the housing and operably engaged with the shaft.

2. The driving tool of claim 1 wherein the collar is moveable only in an axial direction.

3. The driving tool of claim 1 wherein the gear assembly comprises:

a) a sun gear disposed on the shaft;

b) a planetary gear body having at least one planetary gear rotatably mounted thereon, the at least one planetary gear engaged with the sun gear; and c) a ring gear engaged with the at least one planetary gear opposite the sun gear.

4. The driving tool of claim 3 wherein the ring gear includes at least one decent engageable with the collar to hold the collar in an engaged or disengaged position with respect to the ring gear body.

5. The driving tool of claim 3 wherein the shaft extends through the planetary gear body.

6. The driving tool of claim 5 further comprising at least one hearing disposed between and engaged with the planetary gear body and the ring gear.

7. The driving tool of claim 3 wherein the planetary gear body is aligned and engaged with an aperture formed in a radially extending wall disposed on the collar.

8. The driving tool of claim 1 further comprising a torque-limiting mechanism operably connected to the shaft of the gear ratio switching mechanism.

9. The driving tool of claim 8 wherein the torque-limiting mechanism is axially aligned with the shaft output of the gear ratio switching mechanism.

10. The driving tool of claim 9 wherein the torque-limiting mechanism includes at least one structure for providing a ratcheting function to the torque-limiting mechanism.

11. The driving tool of claim 1 further comprising a ratcheting mechanism operably connected to the shaft input of the gear ratio switching mechanism.

12. The driving tool of claim 1 further comprising:

a) a torque-limiting mechanism operably connected to the shaft output of the gear ratio switching mechanism; and b) a ratcheting mechanism operably connected to the shaft input of the gear ratio switching mechanism.

13. A method for switching the gear ratio of a driving tool; the method comprising the steps of:

a) providing the driving tool of claim 1;

b) moving the collar between the engaged and disengaged positions.

14. The method of claim 1 further comprising the step of adjusting the operation of the at least one ratcheting mechanism or torque limiting mechanism.

15. A driving tool comprising:

a) a housing having an open end;

b) a shaft operably connected to the housing and disposed at least partially within the open end;

c) a gear assembly at least partially disposed within the housing and engaged with the shaft;

d) a gear ratio switching mechanism engaged with the gear assembly, the switching mechanism including a collar slidably disposed along an exterior of the housing to slide in a linear axial direction with regard to the gear assembly and a number of teeth disposed on the collar and selectively connected to the gear assembly, wherein the gear assembly comprises:

i) a sun gear disposed on the shaft, wherein the teeth on the collar are engaged with the sun gear;

ii) a planetary gear body having at least one planetary gear rotatably mounted thereon, the at least one planetary gear engaged with the sun gear; and iii) a ring gear engaged with the at least one planetary gear opposite the sun gear, and wherein the collar includes a central aperture through which the sun gear extends and that is selectively engage able with the sun gear.

* * * * *